US009125249B2

(12) United States Patent
Kim et al.

(10) Patent No.: US 9,125,249 B2
(45) Date of Patent: Sep. 1, 2015

(54) PIXEL CIRCUIT AND METHOD FOR DRIVING THEREOF, AND ORGANIC LIGHT EMITTING DISPLAY DEVICE USING THE SAME

(71) Applicant: LG Display Co., Ltd., Seoul (KR)

(72) Inventors: Hyoung-Su Kim, Gyeonggi-do (KR); Bu Yeol Lee, Gyeonggi-do (KR); Jin-Hyun Jung, Busan (KR)

(73) Assignee: LG Display Co., Ltd., Seoul (KR)

( * ) Notice: Subject to any disclaimer, the term of this patent is extended or adjusted under 35 U.S.C. 154(b) by 347 days.

(21) Appl. No.: 13/709,235

(22) Filed: Dec. 10, 2012

(65) Prior Publication Data

US 2014/0084805 A1 Mar. 27, 2014

(30) Foreign Application Priority Data

Sep. 27, 2012 (KR) ..... 10-2012-0108355

(51) Int. Cl.
*H05B 37/02* (2006.01)
*G09G 3/20* (2006.01)
*G09G 3/32* (2006.01)

(52) U.S. Cl.
CPC ..... *H05B 37/02* (2013.01); *G09G 3/2048* (2013.01); *G09G 3/3233* (2013.01); *G09G 2300/043* (2013.01); *G09G 2300/0814* (2013.01); *G09G 2300/0819* (2013.01); *G09G 2300/0861* (2013.01); *G09G 2300/0876* (2013.01); *G09G 2320/0233* (2013.01); *G09G 2360/126* (2013.01)

(58) Field of Classification Search
USPC ..... 315/198, 199, 228, 230–231, 240, 243; 345/44, 46, 33, 82, 84
See application file for complete search history.

(56) References Cited

U.S. PATENT DOCUMENTS 7,057,588 B2 * 6/2006 Asano et al. ..... 345/76
7,230,592 B2 * 6/2007 Sato et al. ..... 345/76
7,339,562 B2 * 3/2008 Ikeda ..... 345/82

(Continued)

FOREIGN PATENT DOCUMENTS

CN 1776794 A 5/2006
CN 101916533 A 12/2010

(Continued)

OTHER PUBLICATIONS

The First Office Action from The State Intellectual Property Office of the People's Republic of China dated May 6, 2015 in counterpart Chinese application No. 201210568091.X.

*Primary Examiner* — An Luu
(74) *Attorney, Agent, or Firm* — Morgan, Lewis & Bockius LLP

(57) ABSTRACT

Disclosed is a pixel circuit which facilitates to compensate a threshold voltage of a driving transistor for controlling an operation state of a light emitting device, and a method for driving thereof and an organic light emitting display device using the same, wherein the pixel circuit includes a light emitting device including an organic light emitting cell; a driving transistor which controls an operation of the light emitting device according to a voltage applied between gate and source terminals; a capacitor including first and second terminals; a switching unit which initializes the capacitor during a current horizontal period, stores a sampling voltage in the capacitor, and makes the light emitting device emit light on the basis of the sampling voltage stored in the capacitor whenever the data voltage and reference voltage are supplied to the data line after the current horizontal period.

20 Claims, 11 Drawing Sheets

(56) References Cited

U.S. PATENT DOCUMENTS

| | | | | |
|---|---|---|---|---|
| 7,408,533 | B2 * | 8/2008 | Eom et al. | 345/76 |
| 7,777,701 | B2 * | 8/2010 | Eom | 345/82 |
| 8,698,714 | B2 * | 4/2014 | Ozawa et al. | 345/82 |
| 2004/0017162 | A1 | 1/2004 | Sato et al. | |
| 2004/0070557 | A1 | 4/2004 | Asano et al. | |
| 2006/0103322 | A1 | 5/2006 | Chung et al. | |
| 2010/0328365 | A1 | 12/2010 | Ikeda et al. | |
| 2013/0127818 | A1 | 5/2013 | Tsai et al. | |
| 2014/0125713 | A1 * | 5/2014 | Ryu et al. | 345/690 |

FOREIGN PATENT DOCUMENTS

| | | | |
|---|---|---|---|
| CN | 101937645 | A | 1/2011 |
| CN | 102436793 | A | 5/2012 |

* cited by examiner

PIXEL CIRCUIT AND METHOD FOR DRIVING THEREOF, AND ORGANIC LIGHT EMITTING DISPLAY DEVICE USING THE SAME

CROSS REFERENCE TO RELATED APPLICATIONS

This application claims the benefit of the Korean Patent Application No. 10-2012-0108355 filed on Sep. 27, 2012, which is hereby incorporated by reference as if fully set forth herein.

BACKGROUND

1. Field of the Invention

The present invention relates to a pixel circuit and an organic light emitting display device using the same, and more particularly, to a pixel circuit capable of compensating a threshold voltage of a driving transistor for controlling an operation state of light emitting device, and a method for driving thereof and an organic light emitting display device using the same.

2. Discussion of the Related Art

According to a recent development of multimedia, there is an increasing demand for a flat panel display. In order to satisfy this increasing demand, various flat panel displays such as liquid crystal display, plasma display panel, field emission display and light emitting display are practically used. Among the various flat panel displays, the light emitting display has been attracted as a next-generation flat panel display owing to advantages of rapid response speed (response speed below 1 ms) and low power consumption. In addition, the light emitting display can emit light in itself, whereby the light emitting display does not cause a problem related with a narrow viewing angle.

Generally, the light emitting display is a display device which emits light by electrically exciting a light emitting material. According to the material and structure, the light emitting display may be classified into an inorganic light emitting display device and an organic light emitting display device.

FIG. 1 is a circuit diagram illustrating a pixel circuit of an organic light emitting display device according to the related art.

Referring to FIG. 1, the pixel circuit of the organic light emitting display device according to the related art includes a switching transistor (ST), a driving transistor (DT), a capacitor (C) and a light emitting device (OLED).

The switching transistor (ST) is switched by a scanning signal supplied to a scanning line (SL), whereby a data voltage (Vdata) supplied to a data line (DL) is supplied to the driving transistor (DT).

The driving transistor (DT) is switched by the data voltage (Vdata) supplied from the switching transistor (ST), to thereby control a data current (Ioled) flowing from a driving power source (Vdd) to the light emitting device (OLED).

The capacitor (C) is connected between gate and source terminals of the driving transistor (DT), wherein the capacitor (C) stores a voltage corresponding to the data voltage (Vdata) supplied to the gate terminal of the driving transistor (DT), and turns on the driving transistor (DT) by the stored voltage.

The light emitting device (OLED) is electrically connected between a drain terminal of the driving transistor (DT) and a ground power source (Vss), wherein the light emitting device (OLED) emits the light by the data current (Ioled) supplied from the driving transistor (DT). In this case, the data current (Ioled) flowing in the light emitting device (OLED) is determined based on a voltage (Vgs) between the gate and source terminals of the driving transistor (DT), a threshold voltage (Vth) of the driving transistor (DT), and the data voltage (Vdata).

In the pixel circuit of the organic light emitting display device according to the related art, a level of the data current (Ioled) flowing from the driving power source (Vdd) to the light emitting device (OLED) is controlled by switching the driving transistor (DT) according to the data voltage (Vdata) so that the light emitting device (OLED) emits the light, to thereby display a predetermined image.

However, in case of the pixel circuit of the organic light emitting display device according to the related art, the data current (Ioled) flowing in the light emitting device (OLED) may be changed by a deviation of the threshold voltage (Vth) of the driving transistor (DT) and a voltage drop of the driving power source (Vdd). Thus, even though the data voltage (Vdata) is identically applied to the pixel circuit of the organic light emitting display device according to the related art, the data current (Ioled) output from each driving transistor (DT) is changed so that it is difficult to realize uniformity in a picture quality.

In addition, according as the organic light emitting display device is increased in size, the above problems related with the deviation of threshold voltage (Vth) of the driving transistor (DT) and the voltage drop of the driving power source (Vdd) become more serious, whereby the picture quality is deteriorated in the large-sized organic light emitting display device.

SUMMARY

Accordingly, the present invention is directed to a pixel circuit and a method for driving thereof, and an organic light emitting display device using the same that substantially obviates one or more problems due to limitations and disadvantages of the related art.

An aspect of the present invention is to provide a pixel circuit which facilitates to compensate a threshold voltage of a driving transistor for controlling an operation state of a light emitting device, and a method for driving thereof and an organic light emitting display device using the same.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a pixel circuit comprising: a light emitting device including an organic light emitting cell formed between an anode electrode and a cathode electrode, wherein the light emitting device emits light by an electric current applied thereto; a driving transistor which controls an operation of the light emitting device according to a voltage applied between gate and source terminals; a capacitor including first and second terminals, wherein the first terminal is selectively supplied with a reference voltage and a data voltage being alternately supplied to a data line, and the second terminal is connected with a first node corresponding to the gate terminal of the driving transistor; and a switching unit which initializes the capacitor during a current horizontal period, stores a sampling voltage including the data voltage and a threshold voltage of the driving transistor in the capacitor, and makes the light emitting device emit light on the basis of the sampling voltage stored in the capacitor whenever the data voltage and reference voltage are supplied to the data line after the current horizontal period.

The switching unit supplies the reference voltage to the first terminal of the capacitor during a partial period of the current horizontal period, and simultaneously supplies an anode voltage to the first node of the light emitting device, thereby initializing the capacitor.

Also, the switching unit supplies the data voltage to the first terminal of the capacitor during the remaining period of the current horizontal period, and then stores the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

The switching unit supplies the reference voltage to the first terminal of the capacitor during the partial period of the current horizontal period, and simultaneously supplies the initializing voltage to the first node, thereby initializing the capacitor.

The switching unit supplies the data voltage to the first terminal of the capacitor during the remaining period of the current horizontal period, and then stores the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

The switching unit makes the light emitting device emit light by supplying the reference voltage to the first terminal of the capacitor stored with the sampling voltage every partial period for each horizontal period after the current horizontal period, wherein the partial period indicates the period when the reference voltage is supplied to the data line; and makes the light emitting device emit light by floating the first terminal of the capacitor stored with the sampling voltage every remaining period for each horizontal period, wherein the remaining period indicates the period when the data voltage of the following horizontal period is supplied to the data line.

In another aspect of the preset invention, there is provided an organic light emitting display device comprising: a display panel including a plurality of pixels with the pixel circuit; a data driver for alternately supplying a reference voltage and a data voltage to a switching unit of the pixel circuit; and a scanning driver for switching the switching unit of the pixel circuit.

In another aspect of the present invention, there is provided a driving method of a pixel circuit comprising a light emitting device including an organic light emitting cell formed between an anode electrode and a cathode electrode, a driving transistor which controls an operation of the light emitting device according to a voltage applied between gate and source terminals, and a capacitor including a first terminal and a second terminal connected with a first node corresponding to the gate terminal of the driving transistor, comprising: alternately supplying a reference voltage and a data voltage to a data line; initializing the capacitor during a current horizontal period, and then storing a sampling voltage including the data voltage and a threshold voltage of the driving transistor in the capacitor; and making the light emitting device emit light on the basis of the sampling voltage stored in the capacitor whenever the data voltage and reference voltage are supplied to the data line after the current horizontal period.

At this time, the step of initializing the capacitor includes supplying the reference voltage supplied to the data line to the first terminal of the capacitor during a partial period of the current horizontal period, and simultaneously supplying an anode voltage of the light emitting device to the first node so as to initialize the capacitor.

Also, the step of initializing the capacitor includes supplying the reference voltage supplied to the data line to the first terminal of the capacitor during a partial period of the current horizontal period, and simultaneously supplying an initializing voltage to the first node so as to initialize the capacitor.

Also, the step of storing the sampling voltage in the capacitor includes supplying the data voltage to the first terminal of the capacitor during the remaining period of the current horizontal period; and storing the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

Also, the step of making the light emitting device emit light includes making the light emitting device emit light by supplying the reference voltage to the first terminal of the capacitor stored with the sampling voltage every partial period for each horizontal period after the current horizontal period, wherein the partial period indicates the period when the reference voltage is supplied to the data line; and making the light emitting device emit light by floating the first terminal of the capacitor stored with the sampling voltage every remaining period for each horizontal period, wherein the remaining period indicates the period when the data voltage of the following horizontal period is supplied to the data line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, a pixel circuit according to the embodiment of the present invention and a method for driving thereof, and an organic light emitting display device using the same will be described with reference to the accompanying drawings.

Figure 1:
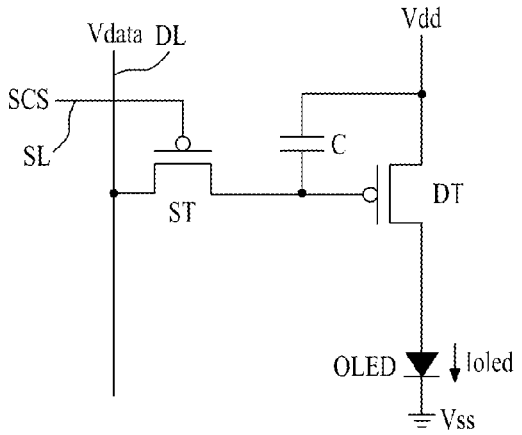
FIG. 1 Related Art
FIG. 1 is a circuit diagram illustrating a pixel circuit of an organic light emitting display device according to the related art.
Figure 2:
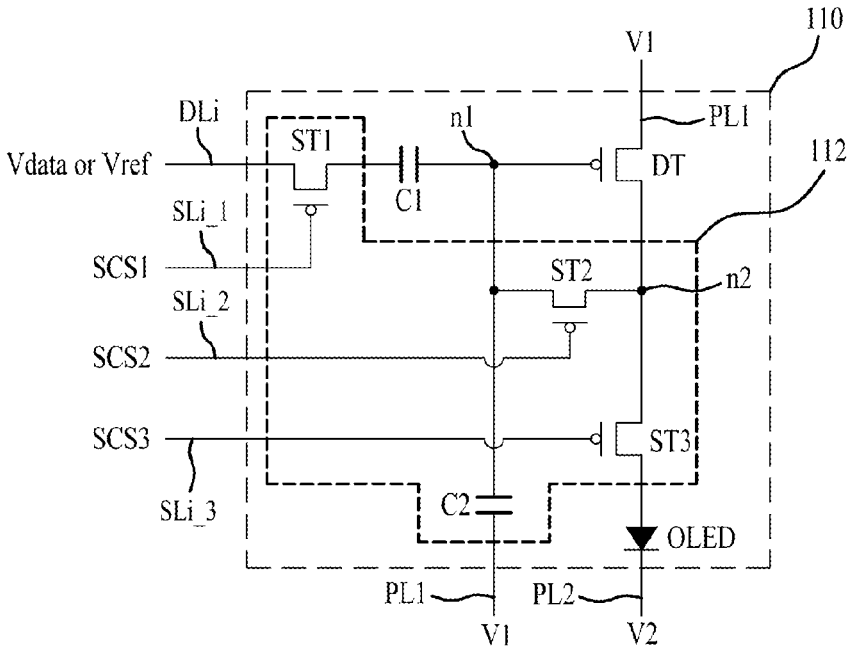
FIG. 2 is a circuit diagram illustrating a pixel circuit according to the first embodiment of the present invention.

FIG. 2 is a circuit diagram illustrating a pixel circuit according to the first embodiment of the present invention.

Referring to FIG. 2, the pixel circuit 110 according to the first embodiment of the present invention includes a light emitting device (OLED) which emits light by an electric current applied thereto; a driving transistor (DT) which controls an operation state of the light emitting device (OLED) according to a voltage applied between gate and source terminals; a capacitor (C1) connected with the gate terminal of the driving transistor (DT); and a switching unit 112 which initializes the capacitor (C1) during a current horizontal period, stores a sampling voltage including a data voltage (Vdata) and a threshold voltage (Vth) of the driving transistor (DT), and makes the light emitting device (OLED) emit light on the basis of the sampling voltage stored in the capacitor (C1) whenever the data voltage (Vdata) and a reference voltage are supplied to a data line (DLi) after the current horizontal period.

When the switching unit 112 is operated, there are an initializing period, a sampling period, a maintaining period, and a light-emitting period. Through these periods, the switching unit 112 compensates the threshold voltage (Vth) of the driving transistor (DT), and makes the light emitting device (OLED) emit light according to a data current determined by a difference between the data voltage (Vdata) and the reference voltage (Vref).

For the initializing period, the switching unit 112 supplies the reference voltage (Vref) to a first terminal of the capacitor (C1) during a partial period of the current horizontal period, and simultaneously supplies an anode voltage of the light emitting device (OLED) to a second terminal of the capacitor (C1) connected with a first node (n1) corresponding to the gate terminal of the driving transistor (DT).

For the sampling period, the switching unit 112 supplies the data voltage (Vdata) of the current horizontal period to the first terminal of the capacitor (C1) during the remaining period of the current horizontal period, and then stores the sampling voltage in the capacitor (C1) by connecting the gate and drain terminals of the driving transistor (DT) with each other, wherein the sampling voltage includes a first driving voltage supplied to the source terminal of the driving transistor (DT), the current data voltage (Vdata), and the threshold voltage (Vth) of the driving transistor (DT).

For the maintaining period, the switching unit 112 maintains the voltage, which is stored in the capacitor (C1) during the sampling period, for 1 horizontal period.

For the light-emitting period, the switching unit 112 makes the light emitting device (OLED) emit light by supplying the reference voltage (Vref) to the first terminal of the capacitor (C1) stored with the sampling voltage every partial period for each horizontal period, wherein the partial period indicates the period when the reference voltage (Vref) is supplied to the data line (DLi), after the current horizontal period; and makes the light emitting device (OLED) emit light by floating the first terminal of the capacitor (C1) stored with the sampling voltage every remaining period for each horizontal period, wherein the remaining period indicates the period when the data voltage (Vdata') of the following horizontal period is supplied to the data line (DLi).

The switching unit 112 is connected with the data line (DLi), the first terminal of the capacitor (C1), the drain terminal of the driving transistor (DT), and an anode electrode of the light emitting device (OLED). The switching unit 112 is switched according to first to third switching control signals (SCS1, SCS2, SCS3), whereby the switching unit 112 initializes the capacitor (C1) during the initializing period, stores the sampling voltage in the capacitor (C1) during the sampling period, maintains the sampling voltage stored in the capacitor (C1) for 1 horizontal period, and then makes the light emitting device (OLED) emit light according to the data current determined by the difference between the data voltage (Vdata) and the reference voltage (Vref) on the basis of the sampling voltage whenever the reference voltage (Vref) and the data voltage (Vdata') are alternately supplied to the data line (DLi). For this, the switching unit 112 includes first to third switching transistors (ST1, ST2, ST3) and an auxiliary capacitor (C2).

First, the reference voltage (Vref) and the data voltage (Vdata) are alternately supplied to the data line (DLi). An alternating period between the reference voltage (Vref) and the data voltage (Vdata) is the half of 1 horizontal period. That is, the reference voltage (Vref) is supplied to the data line (DLi) every partial period for each horizontal period (or the first half period), and the data voltage (Vdata) is supplied to the data line (DLi) every remaining period for each horizontal period (or the last half period). In this case, during the remaining period for each horizontal period, the data voltage corresponding to each horizontal period is supplied to the data line (DLi). The reason why the alternating period between the reference voltage (Vref) and the data voltage (Vdata) is the half of 1 horizontal period is to provide a good timing for supplying the data voltage to each horizontal line.

The reference voltage (Vref) is set to a predetermined voltage value which is lower than that of a driving voltage of the light emitting device (OLED). For example, the reference voltage (Vref) may be the voltage value which is not less than 0V and is less than 2V. In this case, since the switching unit 112 of the present invention makes the light emitting device (OLED) emit light according to the data current determined by the difference between the data voltage (Vdata) and the reference voltage (Vref), the reference voltage (Vref) may be ideally set to 0V. However, it is preferable that the reference voltage (Vref) be set to 1V in consideration of realization of black gray scale. If the reference voltage (Vref) is higher than 0V, the data voltage (Vdata) for each gray scale corresponding to N-bit digital input data may be set to the compensated reference voltage (Vref).

Each of the first to third switching transistors (ST1, ST2, ST3) may be formed of a thin film transistor with P-type conductivity, for example, PMOS transistor.

The first switching transistor (ST1) is switched according to the first switching control signal (SCS1) supplied to a first switching control line (SLi_1), whereby the first switching transistor (ST1) supplies the reference voltage (Vref), supplied to the data line (DLi) during the initializing period and the light-emitting period, to the first terminal of the capacitor (C1); and also supplies the data voltage (Vdata), supplied to the data line (DLi) during the sampling period, to the first terminal of the capacitor (C1). Also, the first switching transistor (ST1) is turned-off by the first switching control signal (SCS1) during the light-emitting period when the data voltage (Vdata') of the other horizontal period is supplied to the data line (DLi), whereby the data voltage (Vdata') of the other horizontal period is not supplied to the capacitor (C1) by floating the first terminal of the capacitor (C1). For this, the first switching transistor (ST1) includes a control electrode (for example, gate electrode) connected with the first switching control line (SLi_1); a first electrode (for example, source electrode) connected with the data line (DLi); and a second electrode (for example, drain electrode) connected with the first terminal of the capacitor (C1).

The second switching transistor (ST2) is turned-on according to the second switching control signal (SCS2) of low voltage supplied to a second switching control line (SLi_2) only during the initializing period and the sampling period, to thereby connect the first node (n1) with a second node (n2) corresponding to the drain terminal of the driving transistor (DT). For this, the second switching transistor (ST2) includes a control electrode (for example, gate electrode) connected with the second switching control line (SLi_2); a first electrode (for example, source electrode) connected with the first node (n1); and a second electrode (for example, drain electrode) connected with the second node (n2).

The third switching transistor (ST3) is turned-on according to the third switching control signal (SCS3) of low voltage supplied to a third switching control line (SLi_3) only during the initializing period and the light-emitting period, to thereby connect the second node (n2) with the anode electrode of the light emitting device (OLED). For this, the third switching transistor (ST3) includes a control electrode (for example, gate electrode) connected with the third switching control line (SLi_3); a first electrode (for example, source electrode) connected with the second node (n2); and a second electrode (for example, drain electrode) connected with the anode electrode of the light emitting device (OLED).

The auxiliary capacitor (C2) is connected with the first node (n1), wherein the auxiliary capacitor (C2) prevents a change of current flowing in the light emitting device (OLED) during the light-emitting period of floating the first terminal of the capacitor (C1) by the turn-off state of the first switching transistor (ST1). For this, the auxiliary capacitor (C2) includes a first terminal connected with the first node (n1) corresponding to the second terminal of the capacitor (C1), the gate terminal of the driving transistor (DT), and the first electrode of the second switching transistor (ST2) in common; and a second terminal connected with a driving power source line (PL1) supplied with the first driving voltage (V1).

In order to prevent the change of current flowing in the light emitting device (OLED) during the light-emitting period of floating the first terminal of the capacitor (C1), a capacitance of the auxiliary capacitor (C2) is higher than a double of a capacitance of the capacitor (C1), preferably. If the capacitance of the auxiliary capacitor (C2) is the same as or lower than the double of the capacitance of the capacitor (C1), it is impossible to prevent a voltage change of the first node (n1) during the light-emitting period of floating the first terminal of the capacitor (C1). In this case, it is difficult to obtain uniform luminance due to the change of current flowing from the driving transistor (DT) to the light emitting device (OLED) according to the voltage change of the first node (n1). Meanwhile, if the capacitance of the auxiliary capacitor (C2) is higher than the double of the capacitance of the capacitor (C1), the high capacitance of the auxiliary capacitor (C2) enables to easily prevent the voltage change of the first node (n1) when the first terminal of the capacitor (C1) is floating.

The driving transistor (DT) includes the gate terminal connected with the first node (n1); the source terminal connected with the first driving power source line (PL1) supplied with the first driving voltage (V1); and the drain terminal connected with the second node (n2). Through the second node (n2), the drain terminal of the driving transistor (DT) is connected with the second electrode of the first switching transistor (ST2) of the switching unit 112 and the first electrode of the third switching transistor (ST3) of the switching unit 112 in common. The driving transistor (DT) is turned-on according to the voltage between the gate and source terminals on the basis of the voltage stored in the capacitor (C1), whereby the data current determined by the difference between the data voltage (Vdata) and the reference voltage (Vref) is supplied to the light emitting device (OLED), to thereby make the light emitting device (OLED) emit light. The driving transistor (DT) is formed of the thin film transistor with P-type conductivity, whereby the driving transistor (DT) has the threshold voltage (Vth) which is less than 0V.

After the capacitor (C1) is initialized according to the switching state in each of the first to third switching transistors (ST1, ST2, ST3) of the switching unit 112, the capacitor (C1) stores the sampling voltage therein, and then turns on the driving transistor (DT) according to the stored voltage. For this, the capacitor (C1) includes the first and second terminals.

The first terminal of the capacitor (C1) is connected with the second electrode of the first switching transistor (ST1) of the switching unit 112. According to the switching state of the first switching transistor (ST1), the reference voltage (Vref) or the data voltage (Vdata) may be selectively supplied to the first terminal of the capacitor (C1). In more detail, the reference voltage (Vref) and the data voltage (Vdata) are sequentially supplied to the first terminal of the capacitor (C1) during the current horizontal period; and the reference voltage (Vref) is supplied thereto every partial period for each horizontal period after the current horizontal period. The first terminal of the capacitor (C1) is floating by the first switching transistor (ST1) of the switching unit 112 which is turned-off every remaining period for each horizontal period after the current horizontal period.

The second terminal of the capacitor (C1) is connected with the first node (n1) corresponding to the gate terminal of the driving transistor (DT), the first electrode of the second switching transistor (ST2), and the first terminal of the auxiliary capacitor (C2) in common.

The light emitting device (OLED) emits light by the data current supplied through the third switching transistor (ST3) of the switching unit 112 according to the driving of the aforementioned driving transistor (DT). For this, the light emitting device (OLED) includes the anode electrode (or pixel electrode) connected with the second electrode of the third switching transistor (ST3); a cathode electrode (or reflective electrode) connected with a second driving power source line (PL2) supplied with a second driving voltage (V2, for example, 0V) which is lower than the first driving voltage (V1); and an organic light emitting cell formed between the anode electrode and the cathode electrode. At this time, the organic light emitting cell may be formed in a deposition structure of hole transport layer/organic light emitting layer/electron transport layer, or a deposition structure of hole injection layer/hole transport layer/organic light emitting layer/electron transport layer/electron injection layer. Further, the organic light emitting cell may be additionally provided with a functional layer for improving light-emitting efficiency and/or lifespan of the light emitting device (OLED).

Figure 3:
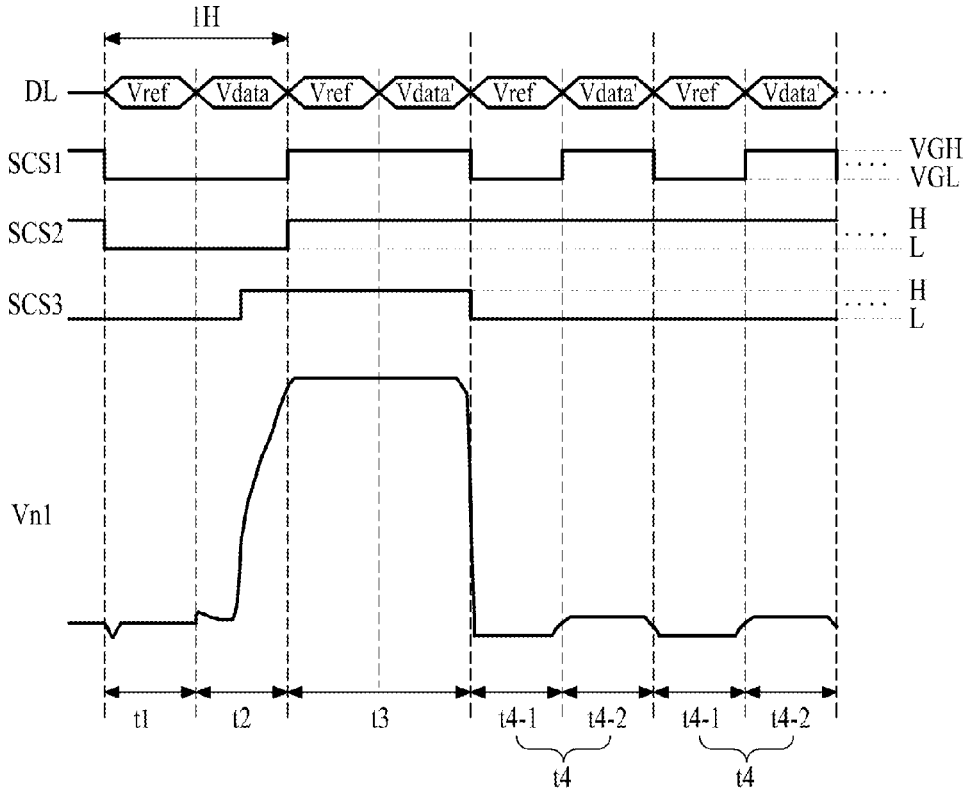
FIG. 3 is a driving waveform diagram illustrating a driving method of the pixel circuit according to the first embodiment of the present invention.

FIG. 3 is a driving waveform diagram illustrating a driving method of the pixel circuit according to the first embodiment of the present invention. FIGS. 4A to 4E illustrate operation states of the pixel circuit according to the respective periods shown in FIG. 3.

The driving method of the pixel circuit according to the first embodiment of the present invention will be described with reference to FIG. 3 in connection with FIGS. 4A to 4E.

As mentioned above, the driving method of the pixel circuit according to the first embodiment of the present invention includes the initializing period (t1), the sampling period (t2), the maintaining period (t3), and the light-emitting period (t4-1, T4-2) with the first light emitting period (t4-1) and the second light emitting period (T4-2).

First, as shown in FIGS. 2 and 3A, during the initializing period (t1) of the current horizontal period, the first switching control signal (SCS1) of gate low voltage (VGL) is supplied to the first switching control line (SLi_1); the second switching control signal (SCS2) of low voltage (L or VGL) is supplied to the second switching control line (SLi_2); the third switching control signal (SCS3) of low voltage (L or VGL) is supplied to the third switching control line (SLi_3); and the reference voltage (Vref) is supplied to the data line (DLi). Accordingly, the switching unit 112 turns on all the first to third switching transistors (ST1, ST2, ST3) during the initializing period (t1), whereby the capacitor (C1) is initialized to a differential voltage between the reference voltage (Vref) and the anode electrode voltage of the light emitting device (OLED).

In more detail, during the initializing period (t1) of the current horizontal period, the first terminal of the capacitor (C1) is connected with the data line (DLi) through the turned-on first switching transistor (ST1); and the second terminal of the capacitor (C1) is connected with the anode electrode of the light emitting device (OLED) through the turned-on second and third switching transistors (ST2, ST3). Accordingly, the reference voltage (Vref) is supplied to the first terminal of the capacitor (C1); and the anode electrode voltage of the light emitting device (OLED) is supplied to the second terminal of the capacitor (C1), that is, first node (n1). Thus, during the initializing period (t1), the voltage (Vn1) of the first node (n1) is initialized to the anode electrode voltage of the light emitting device (OLED) without an additional voltage supplied from an additional power source line.

Meanwhile, during the initializing period (t1) of the current horizontal period, the anode electrode voltage of the light emitting device (OLED) is initialized to the voltage between the cathode electrode and the anode electrode of the light emitting device (OLED) by the current flowing in the light emitting device (OLED) for a preceding frame. During the initializing period (t1), the slight current flows in the light emitting device (OLED) by the anode electrode voltage of the light emitting device (OLED). However, since the initializing period (t1) is very short, the change of luminance caused by the light emitted from the light emitting device (OLED) is invisible to viewer's eyes.

Figure 4A:
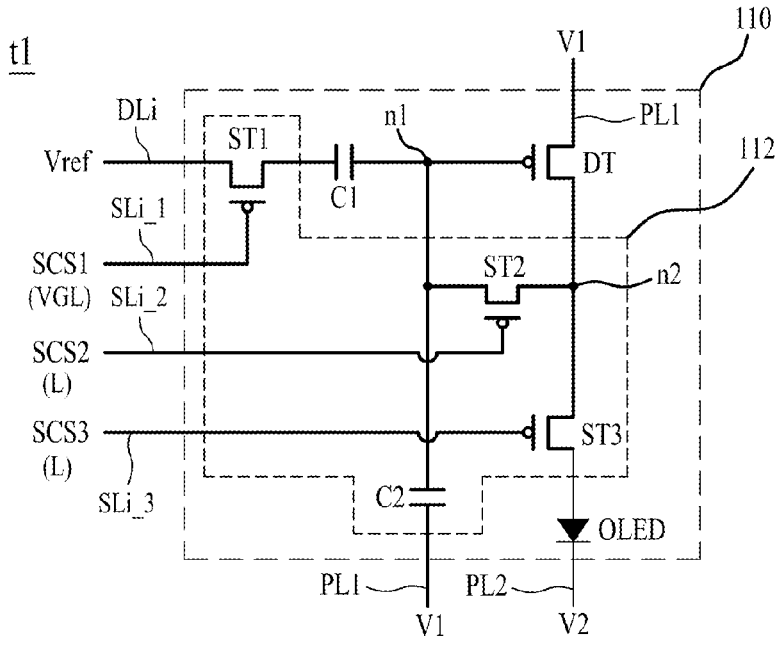
FIGS. 4A to 4E illustrate operation states of the pixel circuit according to respective periods shown in FIG. 3.
Figure 4B:
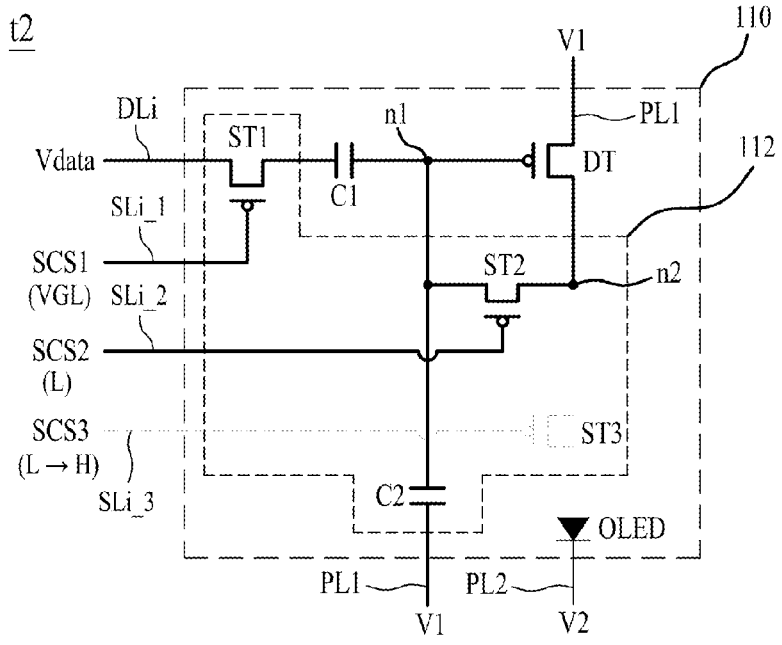

Then, as shown in FIGS. 3 and 4B, during the sampling period (t2) of the current horizontal period, the first switching control signal (SCS1) supplied to the first switching control line (SLi_1) is maintained as the gate low voltage (VGL); the second switching control signal (SCS2) supplied to the second switching control line (SLi_2) is maintained as the low voltage (L or VGL); and the third switching control signal (SCS3) supplied to the third switching control line (SLi_3) is maintained as the low voltage (L or VGL) for a predetermined time period, and is then changed to a high voltage (H or VGH), and thereafter the current data voltage (Vdata) is supplied to the data line (DLi). Thus, during the sampling period (t2), the switching unit 112 maintains the turn-on state of the first and second switching transistors (ST1, ST2), and turns off the third switching transistor (ST3) being in the turn-on state after a predetermined time period, whereby the sampling voltage, determined by the data voltage (Vdata), the threshold voltage (Vth) of the driving transistor (DT) and the first driving voltage (V1), is stored in the capacitor (C1) initialized for the initializing period (t1).

In more detail, during the sampling period (t2) of the current horizontal period, the first terminal of the capacitor (C1) is connected with the data line (DLi) through the first switching transistor (ST1) maintained in the turn-on state; and the second terminal of the capacitor (C1) is connected with the anode electrode of the light emitting device (OLED) through the second and third switching transistors (ST2, ST3) maintained in the turn-on state, and is then connected with the second node (n2) by turning off the third switching transistor (ST3). Thus, during the sampling period (t1) of the current horizontal period, the sampling voltage (V1+Vth−Vdata), which is obtained by subtracting the data voltage (Vdata) from a first voltage obtained by adding the first driving voltage (V1) and the threshold voltage (Vth) of the driving transistor (DT), is sampled and stored in the capacitor (C1). In this case, the threshold voltage (Vth) of the driving transistor (DT) is not an absolute value in each of the first voltage (V1+Vth) and the sampling voltage (V1+Vth−Vdata).

During the sampling period (t2) of the current horizontal period, the drain terminal of the driving transistor (DT) is connected with the first node (n1) through the second switching transistor (ST2) being maintained in the turn-on state by turning off only the third switching transistor (ST3) between the turned-on second and third switching transistors (ST2, ST3), whereby the driving transistor (DT) is connected as a diode type between the first driving power source line (PL1) and the first node (n1). Accordingly, the voltage (Vn1) of the first node (n1) is changed to the first voltage (V1+Vth) obtained by adding the first driving voltage (V1) and the threshold voltage (Vth) of the driving transistor (DT), and the first terminal of the capacitor (C1) is changed to the data voltage (Vdata), whereby the sampling voltage (V1+Vth−Vdata), which is obtained by subtracting the data voltage (Vdata) from the first voltage obtained by adding the first driving voltage (V1) and the threshold voltage (Vth) of the driving transistor (DT), is sampled and stored in the capacitor (C1). Thus, during the sampling period (t2) of the current horizontal period, the capacitor (C1) samples the voltage for compensating a deviation of the threshold voltage (Vth) of the driving transistor (DT) and a voltage drop of the first driving voltage (V1).

At a start point of the sampling period (t2) of the current horizontal period, the voltage (Vn1) of the first node (n1) may be largely changed by the voltage change of the data line (DLi). This change of the voltage (Vn1) of the first node (n1) is restrained and minimized by the auxiliary capacitor (C2) connected with the first node (n1).

During the sampling period (t2) of the current horizontal period, the third switching transistor (ST3) is turned-off after the data voltage (Vdata) is supplied to the first terminal of the capacitor (C1), preferably. That is, if the third switching transistor (ST3) is turned-off before the data voltage (Vdata) is supplied to the first terminal of the capacitor (C1), the voltage (Vn1) of the first node (n1) may be largely changed by the data voltage (Vdata) supplied to the first terminal of the capacitor (C1). Thus, during the sampling period (t2), the voltage (Vn1) of the first node (n1) may be more largely changed in comparison with the first voltage (V1+Vth) obtained by adding the first driving voltage (V1) and the threshold voltage (Vth) of the driving transistor (DT). Accordingly, during the sampling period (t2) of the current horizontal period, in order to prevent the large voltage change of the first node (n1) according to the supply of the data voltage (Vdata), it is preferable that the data voltage (Vdata) be supplied before the third switching transistor (ST3) is turned-off.

Figure 4C:
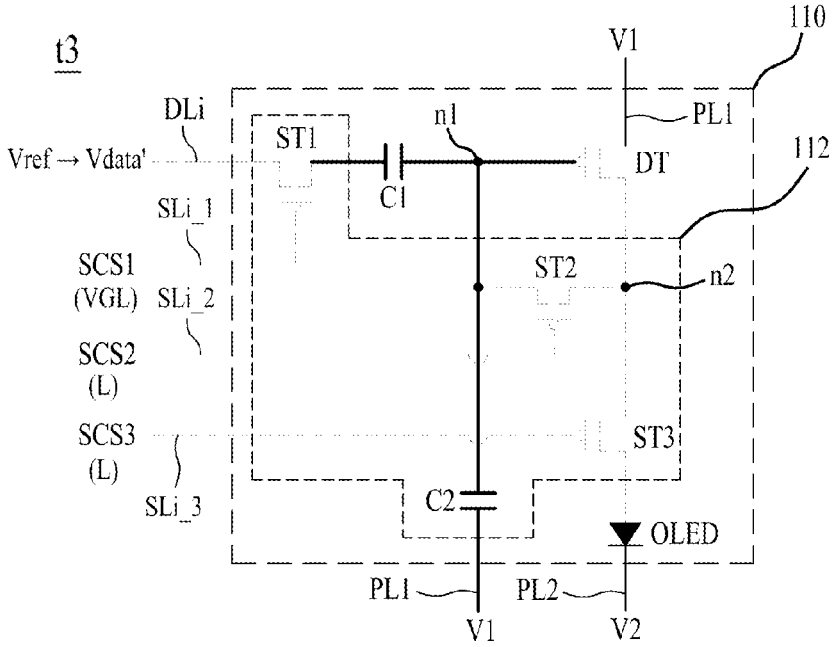

Next, as shown in FIGS. 3 and 4C, during the maintaining period (t3) corresponding to the first horizontal period after the current horizontal period, the first switching control signal (SCS1) of gate high voltage (VGH) is supplied to the first switching control line (SLi_1); the second switching control signal (SCS2) of high voltage (H or VGH) is supplied to the second switching control line (SLi_2); the third switching control signal (SCS3) of high voltage (H or VGH) is supplied to the third switching control line (SLi_3); and the reference voltage (Vref) and the data voltage (Vdata) of the other horizontal line are sequentially supplied to the data line (DLi). Accordingly, during the maintaining period (t3), the switching unit 112 turns off all of the first to third switching transistors (ST1, ST2, ST3), whereby the sampling voltage (V1+Vth−Vdata) stored in the capacitor (C1) during the sampling period (t2) is maintained for 1 horizontal period. This maintaining period (t3) may be omissible. Preferably, the maintaining period (t3) is provided to stabilize waveform (or pulse) according to the state change of the respective first to third switching control signals (SCS1, SCS2, SCS3).

Figure 4D:
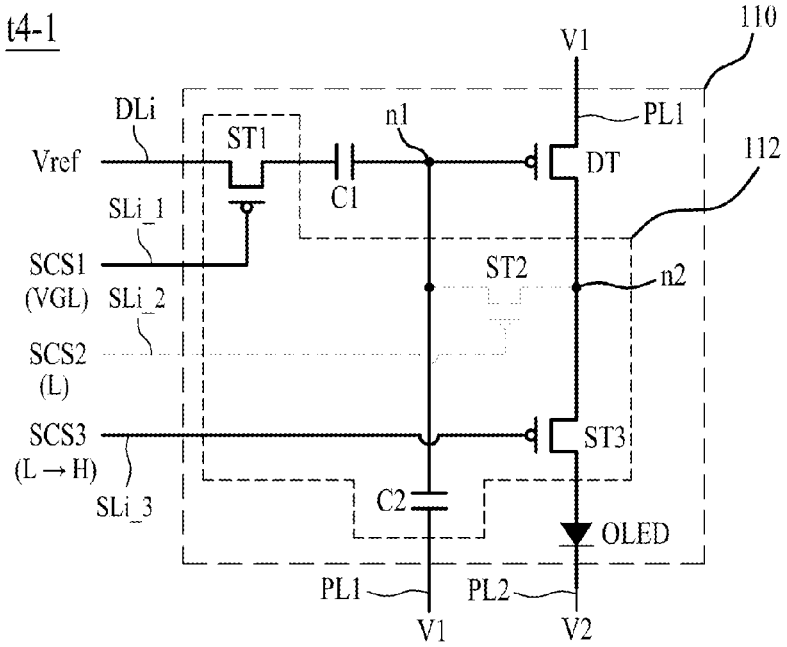

Then, as shown in FIGS. 3 and 4D, during the first light-emitting period (t4-1) of the light-emitting period (t4), which corresponds to the partial period of the second horizontal period after the current horizontal period, the first switching control signal (SCS1) of gate low voltage (VGL) is supplied to the first switching control line (SLi_1); the second switching control signal (SCS2) of high voltage (H or VGH) is supplied to the second switching control line (SLi_2); the third switching control signal (SCS3) of low voltage (L or VGL) is supplied to the third switching control line (SLi_3); and the reference voltage (Vref) is supplied to the data line (DLi). Accordingly, during the first light-emitting period (t4-1), the switching unit 112 turns off only the second switching transistor (ST2) among the first to third switching transistors (ST1, ST2, ST3), whereby the reference voltage (Vref) is supplied to the first terminal of the capacitor (C1) stored with the sampling voltage (V1+Vth−Vdata). Thus, the driving transistor (DT1) is turned-on according to the voltage of the capacitor (C1), whereby the light emitting device (OLED) emits light.

In more detail, during the first light-emitting period (t4-1), the first and third switching transistors (ST1, ST3) are respectively turned-on, and the second switching transistor (ST2) is turned-off so that the reference voltage (Vref) supplied to the data line (DLi) is supplied to the first terminal of the capacitor (C1) stored with the sampling voltage (V1+Vth−Vdata). According to the reference voltage (Vref) supplied to the first terminal of the capacitor (C1), the voltage (Vn1) of the first node (n1) is the voltage (V1+Vth−Vdata+Vref) which is obtained by adding the reference voltage (Vref) and the sampling voltage (V1+Vth−Vdata) stored during the sampling period (t3). During the first light-emitting period (t4-1), the driving transistor (DT) is turned-on by gate and source voltages according to the turn-off state of the second switching transistor (ST2), that is, the voltage (Vn1) of the first node (n1) and the first driving voltage (V1). Thus, as shown in the following Equation 1, the data current (Ioled) determined by the difference between the data voltage (Vdata) and the reference voltage (Vref) is supplied to the light emitting device (OLED) through the turned-on third switching transistor (ST3), whereby the light emitting device (OLED) emits light.

$$\begin{aligned} Ioled &= k(Vgs - Vth)^2 \\ &= k(Vsg - Vth)^2 \\ &= k((V1 - (V1 + Vth - Vdata + Vref)) + Vth)^2 \\ &= k(V1 - V1 - Vth + Vdata - Vref + Vth)^2 \\ &= k(Vdata - Vref)^2 \end{aligned} \quad \text{[Equation 1]}$$

In the above Equation 1, "k" is a proportional constant which is determined by physical properties and structure of the driving transistor (DT), wherein "k" may be determined by mobility of the driving transistor (DT) and "W/L" corresponding to a ratio of channel width (W) to channel length (L) of the driving transistor (DT). Meanwhile, the threshold voltage (Vth) of the driving transistor (DT) is not a constant value, that is, there might be a deviation according to the operation state of the driving transistor (DT).

As known from the above Equation 1, in case of the pixel circuit 110 according to the first embodiment of the present invention, the first driving voltage (V1) and the threshold voltage (Vth) of the driving transistor (DT) are removed so that the data current (Ioled) flowing in the light emitting device (OLED) during the first light-emitting period (t4-1) is not influenced by the first driving voltage (V1) and the threshold voltage (Vth) of the driving transistor (DT), that is, the data current (Ioled) flowing in the light emitting device (OLED) during the first light-emitting period (t4-1) is determined by the difference between the data voltage (Vdata) and the reference voltage (Vref).

Figure 4E:
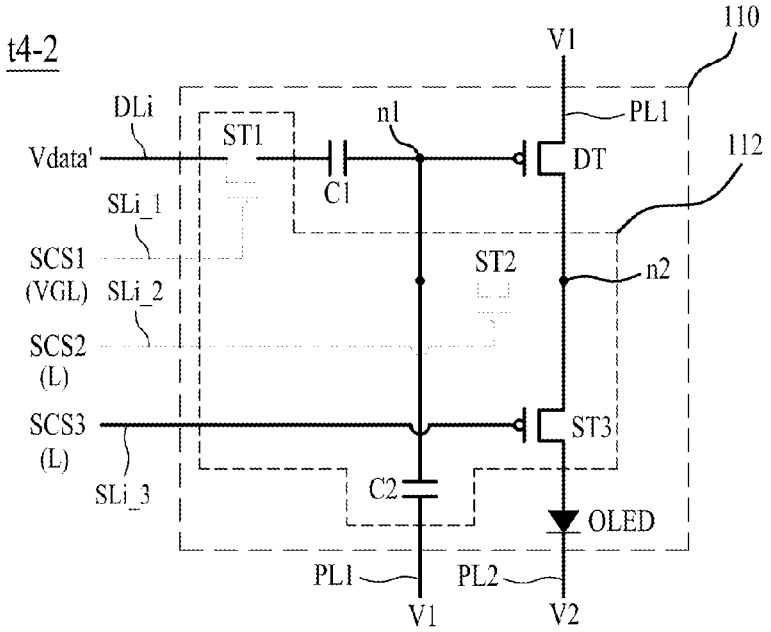

Then, as shown in FIGS. 3 and 4E, during the second light-emitting period (t4-2) of the light-emitting period (t4), which corresponds to the remaining period of the second horizontal period after the current horizontal period, the first switching control signal (SCS1) of gate high voltage (VGH) is supplied to the first switching control line (SLi_1); the second switching control signal (SCS2) of high voltage (H or VGH) is supplied to the second switching control line (SLi_2); the third switching control signal (SCS3) of low voltage (L or VGL) is supplied to the third switching control line (SLi_3); and the data voltage (Vdata') of the following horizontal period is supplied to the data line (DLi). Accordingly, during the second light-emitting period (t4-2), the switching unit 112 turns off the first and second switching transistors (ST1, ST2), and simultaneously turns on the third switching transistor (ST3), whereby the light emitting device (OLED) emits light through the use of voltage of the capacitor (C1) by floating the first terminal of the capacitor (C1).

In more detail, during the second light-emitting period (t4-2), the first terminal of the capacitor (C1) is floating by turning off the first switching transistor (ST1), whereby the data voltage (Vdata') supplied to the data line (DLi) is not supplied to the first terminal of the capacitor (C1). In this case, according as the first terminal of the capacitor (C1) is floating, the voltage (Vn1) of the first node (n1) may be largely changed. As mentioned above, the change of the voltage (Vn1) of the first node (n1) is restrained and minimized by the auxiliary capacitor (C2). Accordingly, during the second light-emitting period (t4-2), the driving transistor (DT) is turned-on by the first driving voltage (V1) and the changed voltage (Vn1) of the first node (n1), whereby the data current, which is decreased at a predetermined ratio in comparison with that of the first light-emitting period (t4-1), is supplied to the light emitting device (OLED) through the turned-on third switching transistor (ST3), to thereby make the light emitting device (OLED) emit light. In this case, the luminance of light emitting device (OLED) is decreased at the predetermined ratio in comparison with that of the first light-emitting period (t4-1). However, since the second light-emitting period (t4-2) is very short, the luminance change of the first and second light-emitting periods (t4-1, t4-2) is invisible to viewer's eyes.

Meanwhile, after the second light-emitting period (t4-2), the switching unit 112 alternately performs the aforementioned first and second light-emitting periods (t4-1, t4-2) to correspond with the data voltage (Vdata') of the following horizontal period and the reference voltage (Vref) which are alternately supplied to the data line (DLi) before the initializing period (t1) of the following frame, whereby the light emitting device (OLED) emits light during the remaining period of the current frame.

As mentioned above, the pixel circuit 110 and its driving method according to the first embodiment of the present invention facilitates to realize the compensation by removing the threshold voltage (Vth) according to the operating state of the driving transistor (DT), and the voltage drop of the first driving voltage (V1) according to resistance of the first driving power source line (PL1), so that it is possible to prevent the picture quality from being lowered by the deviation of the threshold voltage (Vth) of the driving transistor (DT) and the voltage drop of the first driving voltage (V1).

Also, in case of the pixel circuit 110 and its driving method according to the first embodiment of the present invention, the compensation for the threshold voltage (Vth) of the driving transistor (DT) and the periodic light-emitting operation of the light emitting device (OLED) are performed by each horizontal line so that it is possible to prevent a flicker phenomenon. Thus, it is appropriate for realization of large size and high resolution.

Figure 5:
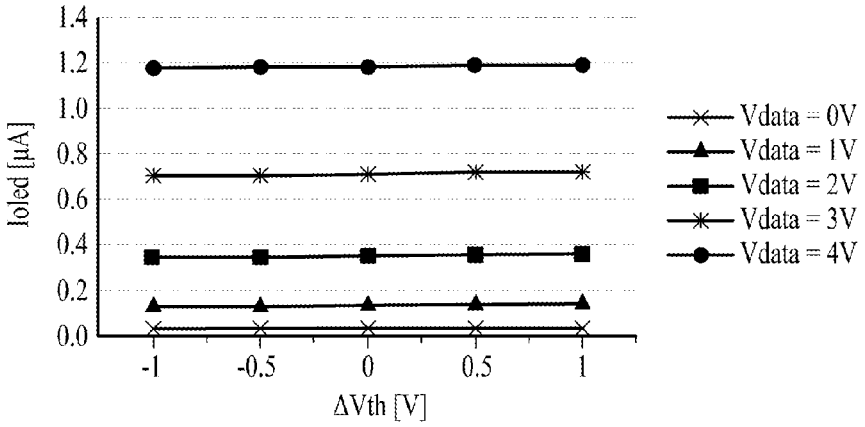
FIG. 5 illustrates a change of current flowing in a light emitting device for each threshold voltage of a driving transistor according to a data voltage in the pixel circuit and its driving method according to the first embodiment of the present invention.

FIG. 5 illustrates the change of current flowing in the light emitting device for each threshold voltage of the driving transistor according to the data voltage in the pixel circuit and its driving method according to the first embodiment of the present invention.

As shown in FIG. 5, the level of current (Ioled) flowing in the light emitting device (OLED) is proportional to the data voltage (Vdata). However, under the condition of the same data voltage (Vdata), the level of current (Ioled) flowing in the light emitting device (OLED) is constantly maintained regardless of the deviation of the threshold voltage (Vth) of the driving transistor (DT).

Figure 6:
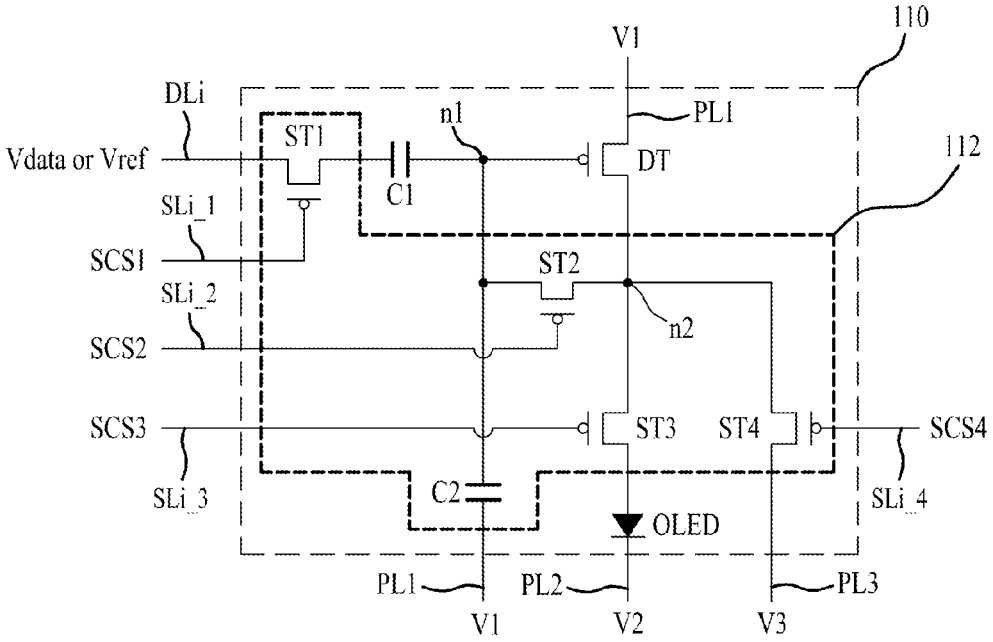
FIG. 6 is a circuit diagram illustrating a pixel circuit according to the second embodiment of the present invention.

FIG. 6 is a circuit diagram illustrating a pixel circuit according to the second embodiment of the present invention.

Referring to FIG. 6, the pixel circuit 110 according to the second embodiment of the present invention includes a light emitting device (OLED), a driving transistor (DT), a capacitor (C1), and a switching unit 112. Except the switching unit 112, the pixel circuit 110 according to the second embodiment of the present invention is identical in structure to the pixel circuit 110 according to the first embodiment of the present invention.

In the same manner as the aforementioned first embodiment of the present invention, when the switching unit 112 is operated, there are an initializing period, a sampling period, a maintaining period, and a light-emitting period. Through these periods, the switching unit 112 compensates a threshold voltage (Vth) of the driving transistor (DT), and makes the light emitting device (OLED) emit light according to a data current determined by a difference between a data voltage (Vdata) and a reference voltage (Vref).

For the initializing period, the switching unit 112 supplies the reference voltage (Vref) to a first terminal of the capacitor (C1) during a partial period of the current horizontal period, and simultaneously supplies a third driving voltage (V3) to a second terminal of the capacitor (C1) connected with a first node (n1) corresponding to a gate terminal of the driving transistor (DT).

For the sampling period, the switching unit 112 supplies the data voltage (Vdata) of the current horizontal period to the first terminal of the capacitor (C1) during the remaining period of the current horizontal period, and then stores a sampling voltage in the capacitor (C1) by the connection between gate and drain terminals of the driving transistor (DT), wherein the sampling voltage includes a first driving voltage (V1) supplied to a source terminal of the driving transistor (DT), the current data voltage (Vdata), and the threshold voltage (Vth) of the driving transistor (DT).

For the maintaining period, the switching unit 112 maintains the voltage, which is stored in the capacitor (C1) during the sampling period, for 1 horizontal period.

For the light-emitting period, the switching unit 112 makes the light emitting device (OLED) emit light by supplying the reference voltage (Vref) to the first terminal of the capacitor (C1) stored with the sampling voltage every partial period for each horizontal period, wherein the partial period indicates the period when the reference voltage (Vref) is supplied to the data line (DLi) after the current horizontal period; and makes the light emitting device (OLED) emit light by floating the first terminal of the capacitor (C1) stored with the sampling voltage every remaining period for each horizontal period, wherein the remaining period indicates the period when the data voltage (Vdata') of the following horizontal period is supplied to the data line (DLi).

The switching unit 112 is connected with the data line (DLi), the first terminal of the capacitor (C1), the drain terminal of the driving transistor (DT), and an anode electrode of the light emitting device (OLED). The switching unit 112 is switched by first to fourth switching control signals (SCS1, SCS2, SCS3, SCS4), whereby the switching unit 112 initializes the capacitor (C1) during the initializing period, stores the sampling voltage in the capacitor (C1) during the sampling period, maintains the sampling voltage stored in the capacitor (C1) for 1 horizontal period, and then makes the light emitting device (OLED) emit light according to the data current determined by the difference between the data voltage (Vdata) and the reference voltage (Vref) on the basis of the sampling voltage whenever the reference voltage (Vref) and the data voltage (Vdata') are alternately supplied to the data line (DLi). For this, the switching unit 112 includes first to fourth switching transistors (ST1, ST2, ST3, ST4) and an auxiliary capacitor (C2), wherein the fourth switching transistor (ST4) is switched by the fourth switching control signal (SCS4). Except a change in a waveform of the third switching control signal (SCS3) for switching the third switching transistor (ST3), the pixel circuit 110 according to the second embodiment of the present invention is identical in structure to the pixel circuit according to the first embodiment of the present invention, whereby a detailed explanation for the same parts will be omitted.

First, the third switching transistor (ST3) is turned-on according to the third switching control signal (SCS3) of low voltage supplied to a third switching control line (SLi_3) only during the light-emitting period, to thereby connect a second node (n2) corresponding to the drain terminal of the driving transistor (DT) with the anode electrode of the light emitting device (OLED). For this, the third switching transistor (ST3) includes a control electrode (for example, gate electrode) connected with the third switching control line (SLi_3); a first electrode (for example, source electrode) connected with the second node (n2); and a second electrode (for example, drain electrode) connected with the anode electrode of the light emitting device (OLED).

The fourth switching transistor (ST4) is switched according to the fourth switching control signal (SCS4) supplied to a fourth switching control line (SLi_4), whereby the third driving voltage (V3) is supplied to the second terminal of the capacitor (C1) connected with the first node (n1) corresponding to the gate terminal of the driving transistor (DT) during the initializing period and the partial period of the sampling period, to thereby initialize the voltage of the first node (n1) to the third driving voltage (V3). For this, the fourth switching transistor (ST4) includes a control electrode (for example, gate electrode) connected with the fourth switching control line (SLi_4); a first electrode (for example, source electrode) connected with the aforementioned second node (n2) corresponding to the drain terminal of the driving transistor (DT), the second electrode of the second switching transistor (ST2), and the first electrode of the third switching transistor (ST3); and a second electrode (for example, drain electrode) connected with a third driving power source line (PL3) supplied with the third driving voltage (V3).

The third driving voltage (V3) is the voltage for initializing the first node (n1), wherein the third driving voltage (V3) is determined within a range of satisfying the turn-on condition of the driving transistor (DT), and the third driving voltage (V3) is set to a value which is lower than the driving voltage of the light emitting device (OLED). The third driving voltage (V3) may the same as or different from the aforementioned reference voltage (Vref). Also, the third driving voltage (V3) may be set to a voltage which is lower than a voltage (V1+Vth) obtained by adding the first driving voltage (V1) supplied to the source terminal of the driving transistor (DT) and the threshold voltage (Vth) of the driving transistor (DT).

The fourth switching transistor (ST4) is turned-on according to the fourth switching control signal (SCS4) during the initializing period and the partial period of the sampling period, whereby the third driving voltage (V3) is supplied to the first node (n1) through the second switching transistor (ST2) being turned-on during the initializing period and the sampling period, in the same manner as the aforementioned first embodiment of the present invention. Thus, during the initializing period and the partial period of the sampling period, the voltage of the first node (n1) is initialized to the third driving voltage (V3) regardless of the voltage in both ends of the light emitting device (OLED) according to the flow of the preceding data current.

As mentioned above, the switching unit 112 of the pixel circuit 110 according to the second embodiment of the present invention initializes the voltage of the first node (n1) to the third driving voltage (V3) through the use of fourth switching transistor (ST4) during the initializing period and the partial period of the sampling period, to thereby stably perform the initialization of the first node (n1). Also, it is possible to prevent the light emitting device (OLED) from emitting even a small amount of light during the initializing period, to thereby extend a lifespan of the light emitting device (OLED). In addition, during the sampling period, the threshold voltage (Vth) of the driving transistor (DT) is detected and stored in the capacitor (C1), thereby improving efficiency in detecting the threshold voltage (Vth) of the driving transistor (DT).

Figure 7:
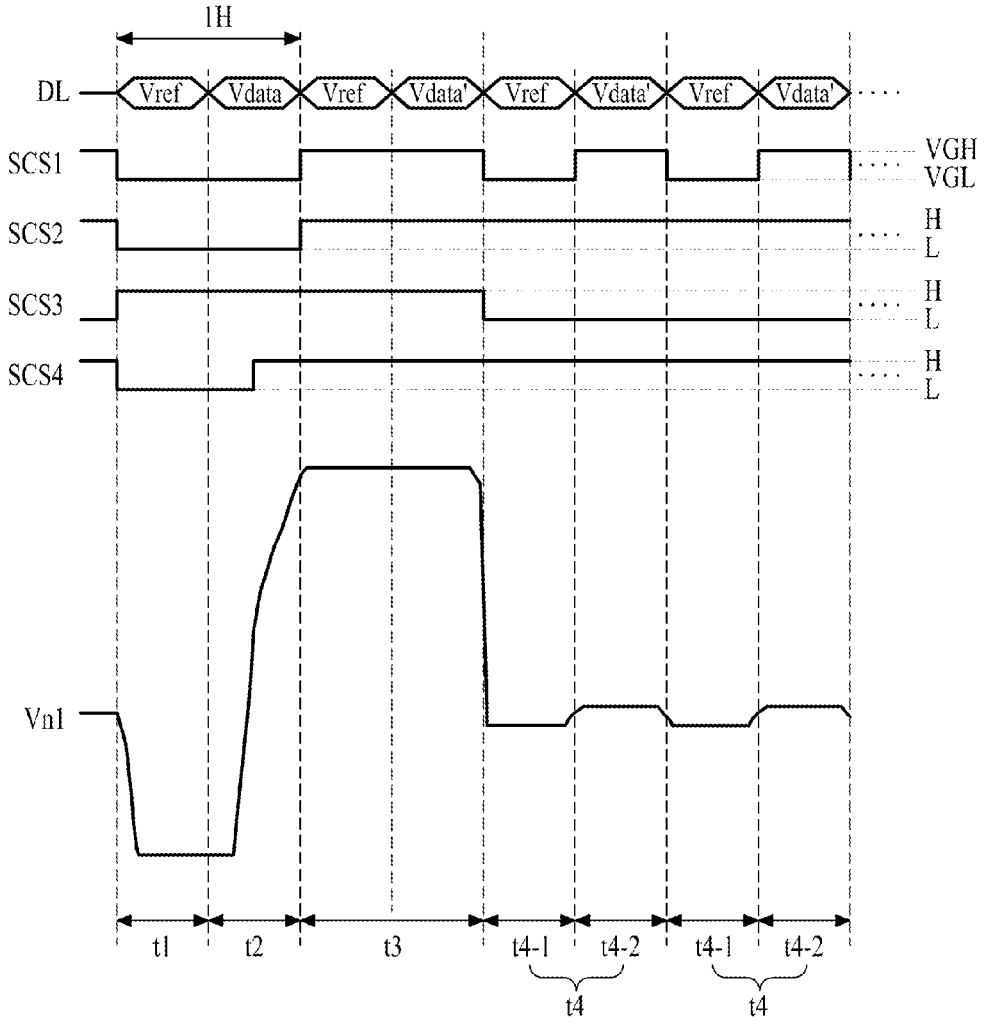
FIG. 7 is a driving waveform diagram illustrating a driving method of the pixel circuit according to the second embodiment of the present invention.

FIG. 7 is a driving waveform diagram illustrating a driving method of the pixel circuit according to the second embodiment of the present invention. FIGS. 8A to 8E illustrate operation states of the pixel circuit according to the respective periods shown in FIG. 7.

The driving method of the pixel circuit according to the second embodiment of the present invention will be described with reference to FIG. 7 in connection with FIGS. 8A to 8E.

As mentioned above, the driving method of the pixel circuit according to the second embodiment of the present invention includes the initializing period (t1), the sampling period (t2), the maintaining period (t3), and the light emitting period (t4-1, t4-2) with the first light emitting period (t4-1) and the second light emitting period (t4-2).

Figure 8A:
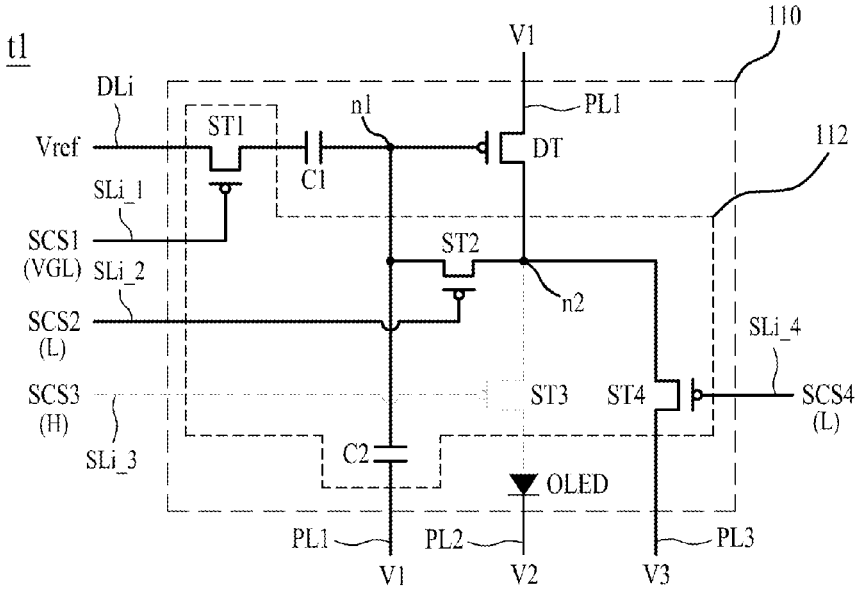
FIGS. 8A to 8E illustrate operation states of the pixel circuit according to respective periods shown in FIG. 7.

First, as shown in FIGS. 7 and 8A, during the initializing period (t1) of the current horizontal period, the first switching control signal (SCS1) of gate low voltage (VGL) is supplied to a first switching control line (SLi_1); the second switching control signal (SCS2) of low voltage (L or VGL) is supplied to a second switching control line (SLi_2); the third switching control signal (SCS3) of high voltage (H or VGH) is supplied to the third switching control line (SLi_3); the fourth switching control signal (SCS4) of low voltage (L or VGL) is supplied to the fourth switching control line (SLi_4); and the reference voltage (Vref) is supplied to the data line (DLi). Accordingly, while the switching unit 112 turns on the first, second and fourth switching transistors (ST1, ST2, ST4) at the same time during the initializing period (t1), the switching unit 112 turns off the third switching transistor (ST3), whereby the capacitor (C1) is initialized to a differential voltage between the reference voltage (Vref) and the third driving voltage (V3).

In more detail, during the initializing period (t1) of the current horizontal period, the first terminal of the capacitor (C1) is connected with the data line (DLi) through the turned-on first switching transistor (ST1); and the second terminal of the capacitor (C1) is connected with the third driving power source line (PL3) through the turned-on second and fourth switching transistors (ST2, ST4). Accordingly, the reference voltage (Vref) is supplied to the first terminal of the capacitor (C1); the third driving voltage (V3) is supplied from the third driving power source line (PL3) to the first node (n1), that is, the second terminal of the capacitor (C1). Thus, during the initializing period (t1), the voltage (Vn1) of the first node (n1) is initialized to the third driving voltage (V3).

Meanwhile, during the initializing period (t1) of the current horizontal period, a current path is not formed between the second node (n2) and the second driving power source line (PL2), whereby the light emitting device (OLED) does not emit light. This is because the voltage of the second node (n2), that is, the anode electrode voltage of the light emitting device (OLED) is maintained as the third driving voltage (V3) by the turned-on fourth switching transistor (ST4) during the initializing period (t1).

Figure 8B:
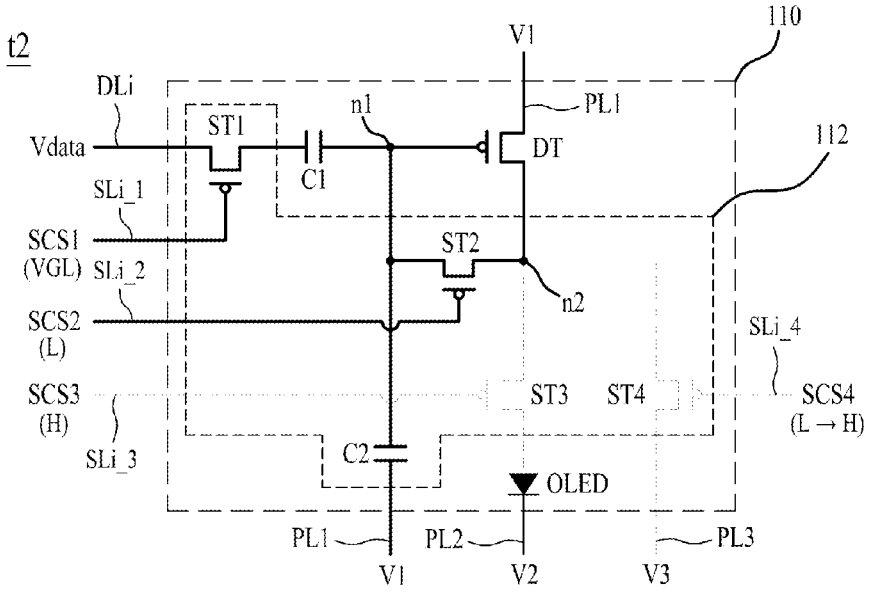

Then, as shown in FIGS. 7 and 8B, during the sampling period (t2) of the current horizontal period, the first switching control signal (SCS1) supplied to the first switching control line (SLi_1) is maintained as the gate low voltage (VGL); the second switching control signal (SCS2) supplied to the second switching control line (SLi_2) is maintained as the low voltage (L or VGL); the third switching control signal (SCS3) supplied to the third switching control line (SLi_3) is maintained as the low voltage (L or VGL); the fourth switching control signal (SCS4) supplied to the fourth switching control line (SLi_4) is maintained as the low voltage (L or VGL) for a predetermined time period, and is then changed to the high voltage (H or VGH), and thereafter the current data voltage (Vdata) is supplied to the data line (DLi). Thus, during the sampling period (t2), the switching unit 112 maintains the turn-on state of the first and second switching transistors (ST1, ST2); maintains the turn-off state of the third switching transistor (ST3); and turns off the fourth switching transistor (ST4) being in the turn-on state after a predetermined time period, whereby the sampling voltage, determined by the data voltage (Vdata), the threshold voltage (Vth) of the driving transistor (DT) and the first driving voltage (V1), is stored in the capacitor (C1) initialized for the initializing period (t1).

In more detail, during the sampling period (t2) of the current horizontal period, the first terminal of the capacitor (C1) is connected with the data line (DLi) through the first switching transistor (ST1) maintained in the turn-on state; and the second terminal of the capacitor (C1) is connected with the third driving power source line (PL3) through the second and fourth switching transistors (ST2, ST4) maintained in the turn-on state, and is then connected with the second node (n2) by turning off the fourth switching transistor (ST4). Thus, during the sampling period (t1) of the current horizontal period, the sampling voltage (V1+Vth−Vdata), which is obtained by subtracting the data voltage (Vdata) from a first voltage obtained by adding the first driving voltage (V1) and the threshold voltage (Vth) of the driving transistor (DT), is sampled and stored in the capacitor (C1). In this case, the threshold voltage (Vth) of the driving transistor (DT) is not an absolute value in each of the first voltage (V1+Vth) and the sampling voltage (V1+Vth−Vdata).

During the sampling period (t2) of the current horizontal period, the drain terminal of the driving transistor (DT) is connected with the first node (n1) through the second switching transistor (ST2) being maintained in the turn-on state by turning off only the fourth switching transistor (ST4) between the turned-on second and fourth switching transistors (ST2, ST4), whereby the driving transistor (DT) is connected as a diode type between the first driving power source line (PL1) and the first node (n1). Accordingly, the voltage (Vn1) of the first node (n1) is changed to the first voltage (V1+Vth) obtained by adding the first driving voltage (V1) and the threshold voltage (Vth) of the driving transistor (DT), and the first terminal of the capacitor (C1) is changed to the data voltage (Vdata), whereby the sampling voltage (V1+Vth−Vdata), which is obtained by subtracting the data voltage (Vdata) from the first voltage obtained by adding the first driving voltage (V1) and the threshold voltage (Vth) of the driving transistor (DT), is sampled and stored in the capacitor (C1). Thus, during the sampling period (t2) of the current horizontal period, the voltage for compensating a deviation of the threshold voltage (Vth) of the driving transistor (DT) and a voltage drop of the first driving voltage (V1) is sampled in the capacitor (C1).

At a start point of the sampling period (t2) of the current horizontal period, the voltage (Vn1) of the first node (n1) may be largely changed by the voltage change of the data line (DLi). This change of the voltage (Vn1) of the first node (n1) is restrained and minimized by the auxiliary capacitor (C2) connected with the first node (n1).

During the sampling period (t2) of the current horizontal period, the fourth switching transistor (ST4) is turned-off after the data voltage (Vdata) is supplied to the first terminal of the capacitor (C1), preferably. That is, if the fourth switching transistor (ST4) is turned-off before the data voltage (Vdata) is supplied to the first terminal of the capacitor (C1), the voltage (Vn1) of the first node (n1) may be largely changed by the data voltage (Vdata) supplied to the first terminal of the capacitor (C1). Thus, during the sampling period (t2), the voltage (Vn1) of the first node (n1) may be more largely changed in comparison with the first voltage (V1+Vth) obtained by adding the first driving voltage (V1) and the threshold voltage (Vth) of the driving transistor (DT). Accordingly, during the sampling period (t2) of the current horizontal period, in order to prevent the large voltage change of the first node (n1) according to the supply of the data voltage (Vdata), it is preferable that the data voltage (Vdata) be supplied before the fourth switching transistor (ST4) is turned-off.

Figure 8C:
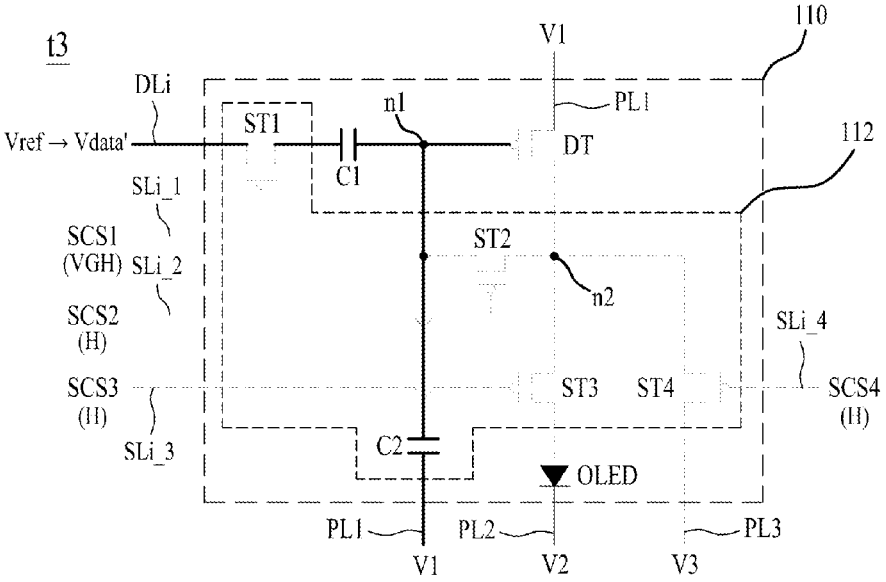

Next, as shown in FIGS. 7 and 8C, during the maintaining period (t3) corresponding to the first horizontal period after the current horizontal period, the first switching control signal (SCS1) of gate high voltage (VGH) is supplied to the first switching control line (SLi_1); the second switching control signal (SCS2) of high voltage (H or VGH) is supplied to the second switching control line (SLi_2); the third switching control signal (SCS3) of high voltage (H or VGH) is supplied to the third switching control line (SLi_3); the fourth switching control signal (SCS4) of high voltage (H or VGH) is supplied to the fourth switching control line (SLi_4); and the reference voltage (Vref) and the data voltage (Vdata) of the other horizontal line are sequentially supplied to the data line (DLi). Accordingly, during the maintaining period (t3), the switching unit 112 turns off all of the first to fourth switching transistors (ST1, ST2, ST3, ST4), whereby the sampling voltage (V1+Vth−Vdata) stored in the capacitor (C1) during the sampling period (t2) is maintained for 1 horizontal period. This maintaining period (t3) may be omissible. Preferably, the maintaining period (t3) is provided to stabilize waveform (or pulse) according to the state change of the respective first to fourth switching control signals (SCS1, SCS2, SCS3, SCS4).

Figure 8D:
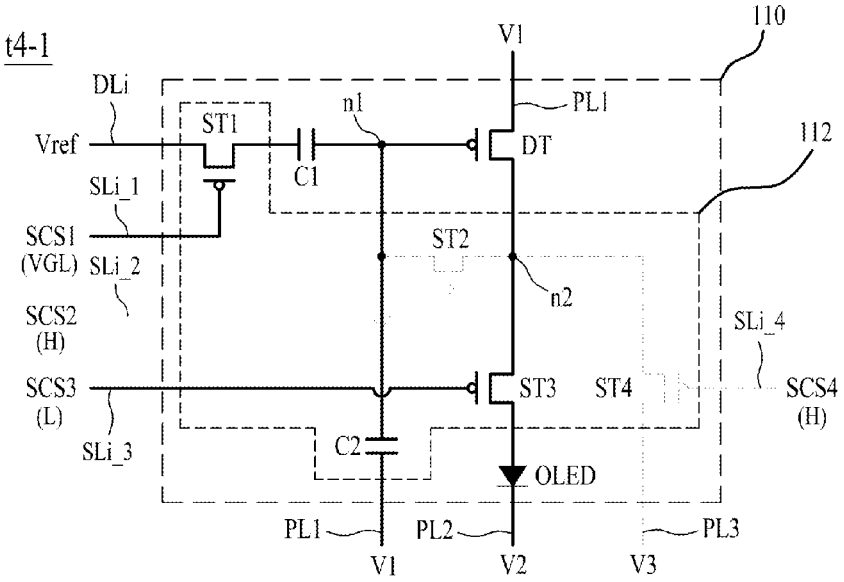

Then, as shown in FIGS. 7 and 8D, during the first light-emitting period (t4-1) of the light-emitting period (t4), which corresponds to the partial period of the second horizontal period after the current horizontal period, the first switching control signal (SCS1) of gate low voltage (VGL) is supplied to the first switching control line (SLi_1); the second switching control signal (SCS2) of high voltage (H or VGH) is supplied to the second switching control line (SLi_2); the third switching control signal (SCS3) of low voltage (L or VGL) is supplied to the third switching control line (SLi_3); the fourth switching control signal (SCS4) of high voltage (H or VGH) is supplied to the fourth switching control line (SLi_4); and the reference voltage (Vref) is supplied to the data line (DLi). Accordingly, during the first light-emitting period (t4-1), the switching unit 112 turns on the first and third switching transistors (ST1, ST3) among the first to fourth switching transistors (ST1, ST2, ST3, ST4), whereby the reference voltage (Vref) is supplied to the first terminal of the capacitor (C1) stored with the sampling voltage (V1+Vth−Vdata). Thus, the driving transistor (DT1) is turned-on according to the voltage of the capacitor (C1), whereby the light emitting device (OLED) emits light.

In more detail, during the first light-emitting period (t4-1), the first and third switching transistors (ST1, ST3) are respectively turned-on, and the second and fourth switching transistors (ST2, ST4) are turned-off so that the reference voltage (Vref) supplied to the data line (DLi) is supplied to the first terminal of the capacitor (C1) stored with the sampling voltage (V1+Vth−Vdata). Thus, the voltage (Vn1) of the first node (n1) becomes the voltage (V1+Vth−Vdata+Vref) which is obtained by adding the reference voltage (Vref) and the sampling voltage (V1+Vth−Vdata) stored during the sampling period (t3) according to the reference voltage (Vref) supplied to the first terminal of the capacitor (C1). During the first light-emitting period (t4-1), the driving transistor (DT) is turned-on by gate and source voltages according to the turn-off state of the second switching transistor (ST2), that is, the voltage (Vn1) of the first node (n1) and the first driving voltage (V1). Thus, as shown in the above Equation 1, the data current (Ioled) determined by the difference between the data voltage (Vdata) and the reference voltage (Vref) is supplied to the light emitting device (OLED) through the turned-on third switching transistor (ST3), whereby the light emitting device (OLED) emits light.

As known from the above Equation 1, in case of the pixel circuit 110 according to the second embodiment of the present invention, the first driving voltage (V1) and the threshold voltage (Vth) of the driving transistor (DT) are removed so that the data current (Ioled) flowing in the light emitting device (OLED) during the first light-emitting period (t4-1) is not influenced by the first driving voltage (V1) and the threshold voltage (Vth) of the driving transistor (DT), that is, the data current (Ioled) flowing in the light emitting device (OLED) during the first light-emitting period (t4-1) is determined only by the difference between the data voltage (Vdata) and the reference voltage (Vref).

Figure 8E:
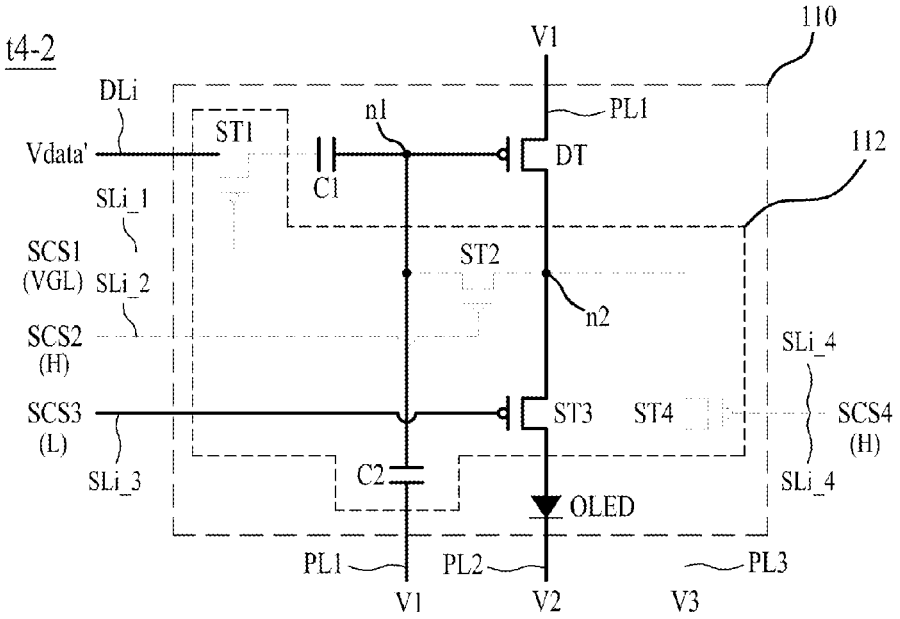

Then, as shown in FIGS. 7 and 8E, during the second light-emitting period (t4-2) of the light-emitting period (t4), which corresponds to the remaining period of the second horizontal period after the current horizontal period, the first switching control signal (SCS1) of gate high voltage (VGH) is supplied to the first switching control line (SLi_1); the second switching control signal (SCS2) of high voltage (H or VGH) is supplied to the second switching control line (SLi_2); the third switching control signal (SCS3) of low voltage (L or VGL) is supplied to the third switching control line (SLi_3); the fourth switching control signal (SCS4) of high voltage (H or VGH) is supplied to the fourth switching control line (SLi_4); and the data voltage (Vdata') of the following horizontal period is supplied to the data line (DLi). Accordingly, during the second light-emitting period (t4-2), the switching unit 112 turns off the first, second and fourth switching transistors (ST1, ST2, ST4), and simultaneously turns on the third switching transistor (ST3), whereby the light emitting device (OLED) emits light through the use of voltage of the capacitor (C1) by floating the first terminal of the capacitor (C1).

In more detail, during the second light-emitting period (t4-2), the first terminal of the capacitor (C1) is floating by turning off the first switching transistor (ST1), whereby the data voltage (Vdata') supplied to the data line (DLi) is not supplied to the first terminal of the capacitor (C1). In this case, according as the first terminal of the capacitor (C1) is floating, the voltage (Vn1) of the first node (n1) may be largely changed. As mentioned above, the change of the voltage (Vn1) of the first node (n1) is restrained and minimized by the auxiliary capacitor (C2). Accordingly, during the second light-emitting period (t4-2), the driving transistor (DT) is turned-on by the first driving voltage (V1) and the changed voltage (Vn1) of the first node (n1), whereby the data current, which is decreased at a predetermined ratio in comparison with that of the first light-emitting period (t4-1), is supplied to the light emitting device (OLED) through the turned-on third switching transistor (ST3), to thereby make the light emitting device (OLED) emit light. In this case, the luminance of light emitting device (OLED) is decreased at the predetermined ratio in comparison with that of the first light-emitting period (t4-1). However, since the second light-emitting period (t4-2) is very short, the luminance change of the first and second light-emitting periods (t4-1, t4-2) is invisible to viewer's eyes.

Meanwhile, after the second light-emitting period (t4-2), the switching unit 112 alternately performs the aforementioned first and second light-emitting periods (t4-1, t4-2) to correspond with the data voltage (Vdata') of the following horizontal period and the reference voltage (Vref) which are alternately supplied to the data line (DLi) before the initializing period (t1) of the following frame, whereby the light emitting device (OLED) emits light during the remaining period of the current frame.

As mentioned above, the pixel circuit 110 and its driving method according to the second embodiment of the present invention provides the same effects as those of the first embodiment of the present invention, and also enables to stably perform the initialization of the first node (n1) through the use of third driving voltage (V3) during the initializing period (t1).

In the aforementioned switching unit 112 of the pixel circuit 110 according to the second embodiment of the present invention, the second electrode of the second switching transistor (ST2) is connected with the third driving power source line (PL3), but not limited to this structure. For example, the second electrode of the second switching transistor (ST2) may be connected with the second driving power source line (PL2), which also enables to stably perform the initialization of the first node (n1) during the initializing period (t1).

On the other hand, the first electrode of the second switching transistor (ST2) is connected with the second node (n2), but not limited to this structure. For example, the first electrode of the second switching transistor (ST2) may be connected with the first node (n1), which also enables to stably perform the initialization of the first node (n1) during the initializing period (t1). In this case, the second electrode of the second switching transistor (ST2) may be connected with the aforementioned second driving power source line (PL2) or third driving power source line (PL3).

Figure 9:
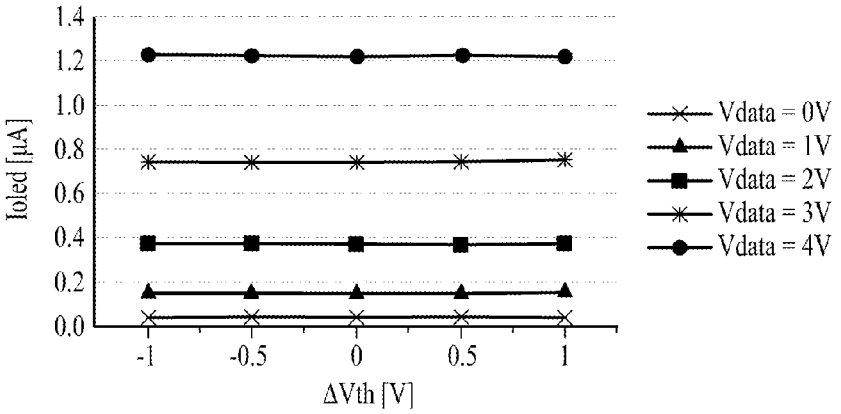
FIG. 9 illustrates a change of current flowing in a light emitting device for each threshold voltage of a driving transistor according to a data voltage in the pixel circuit and its driving method according to the second embodiment of the present invention.

FIG. 9 illustrates the change of current flowing in the light emitting device for each threshold voltage of the driving transistor according to the data voltage in the pixel circuit and its driving method according to the second embodiment of the present invention.

As shown in FIG. 9, the level of current (Ioled) flowing in the light emitting device (OLED) is proportional to the data voltage (Vdata). However, under the condition of the same data voltage (Vdata), the level of current (Ioled) flowing in the light emitting device (OLED) is constantly maintained regardless of the deviation (ΔVth) of the threshold voltage (Vth) of the driving transistor (DT).

For the above description about the pixel circuit 110 according to the first and second embodiments of the present invention, the driving transistor and the switching transistors are formed of PMOS thin film transistors with P-type conductivity, but not necessarily. For example, the driving transistor and the switching transistors may be formed of NMOS thin film transistors with N-type conductivity. In this case, the NMOS thin film transistors may include oxide semiconductor.

Figure 10:
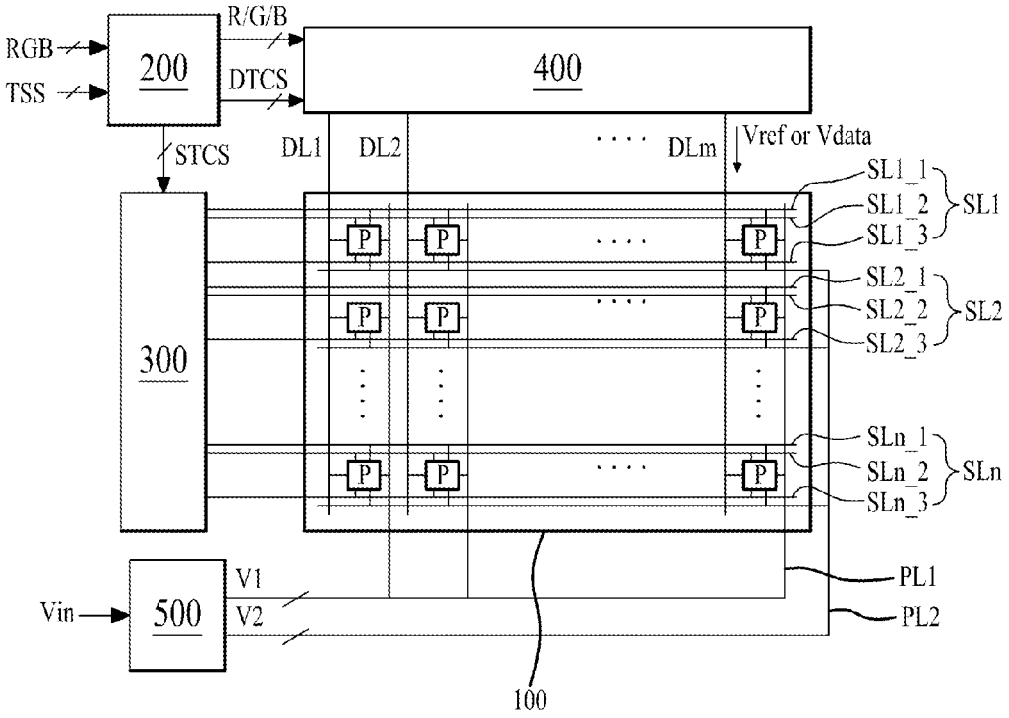
FIG. 10 illustrates a light emitting display device according to the embodiment of the present invention.

FIG. 10 illustrates a light emitting display device according to the embodiment of the present invention.

Referring to FIG. 10, the light emitting display device according to the embodiment of the present invention includes a display panel 100, a timing controller 200, a scanning driver 300, a data driver 400, and a power supplier 500.

The display panel 100 includes a plurality of pixels (P) which are formed every pixel region defined by a plurality of data lines (DL1 to DLm), a plurality of scanning line groups (SL1 to SLn) and a plurality of first and second driving power source lines (PL1, PL2), wherein each scanning line group is provided with a plurality of first to third switching control lines (SLi_1, SLi_2, SLi_3, 'i' is an integer between 1 and 'n').

Each of the pixels (P) includes the pixel circuit 110 shown in FIG. 2 according to the first embodiment of the present invention. Each of the pixels (P) for each horizontal line connected with each scanning line group (SL1 to SLn) is driven according to the driving method of the pixel circuit 110 according to the first embodiment of the present invention as shown in FIGS. 3 and 4A to 4E. Accordingly, a detailed explanation for each pixel (P) and its driving method will be substituted by the above description of FIGS. 2, 3 and 4A to 4E.

The timing controller 200 aligns red, green and blue input data (RGB), which is input from an external system body (not shown) or graphic card (not shown), so as to be in the state appropriate for driving the display panel 100, and then the alignment data (R/G/B) is supplied to the data driver 400.

Also, the timing controller 200 controls a driving timing for each of the scanning driver 300 and the data driver 400 according to a timing synchronous signal (TSS) input from the external system body or graphic card. That is, the timing controller 200 generates a scanning timing control signal (STCS) and a data timing control signal (DTCS) on the basis of timing synchronous signal (TSS) such as vertical synchronous signal (Vsync), horizontal synchronous signal (Hsync), data enable (DE), clock (DCLK), and etc., and then controls the driving timing for each of the scanning driver 300 and the data driver 400 by the use of generated scanning timing control signal (STCS) and data timing control signal (DTCS).

The scanning driver 300 generates the aforementioned first to third switching control signals (See FIG. 3) which are shifted by each unit of 1 horizontal period according to the scanning timing control signal (STCS) supplied from the timing controller 200; and then sequentially supplies the generated first to third switching control signals to the plurality of scanning line groups (SL1 to SLn). In this case, the first switching control signal (SCS1) is supplied to the first switching control line (SL1_1 to SLn_1) for each of the plurality of scanning line groups (SL1 to SLn); the second switching control signal (SCS2) is supplied to the second switching control line ($SL1__2$ to SLn_2) for each of the plurality of scanning line groups (SL1 to SLn); and the third switching control signal (SCS3) is supplied to the third switching control line ($SL1__3$ to SLn_3) for each of the plurality of scanning line groups (SL1 to SLn).

The scanning driver 300 may be formed in a non-display area at one side and/or the other side of the display panel 100 by Gate-In-Panel (GIP) method during a thin film transistor process of the aforementioned display panel 100; or the scanning driver 300 of a chip type may be mounted on the non-display area by Chip-On-Glass (COG) method.

The data driver 400 alternately supplies the predetermined reference voltage (Vref) and the data voltage (Vdata) to the corresponding data line (DL1 to DLm) during each horizontal period overlapped with the first switching control signal according to the data timing control signal (DTCS) supplied from the timing controller 200. That is, the data driver 400 generates the predetermined reference voltage (Vref) and supplies the generated reference voltage (Vref) to the corresponding data line (DL1 to DLm) during the partial period for each horizontal period (or the first half period) according to the data timing control signal (DTCS). Also, the data driver 400 sequentially latches the alignment data (R/G/B) supplied from the timing controller 200 in response to the data timing control signal (DTCS); selects a gamma voltage corresponding to the latched alignment data (R/G/B) as the data voltage (Vdata) among a plurality of different gamma voltages; and supplies the selected data voltage (Vdata) to the corresponding data line (DL1 to DLm) during the remaining period for each horizontal period (or the last half period). For this, the data driver 400 includes a plurality of output voltage selectors (not shown) so as to alternately output the predetermined reference voltage (Vref) and the data voltage (Vdata) for each horizontal period. The plurality of output voltage selectors are switched by the half unit for each horizontal period according to a data output selecting signal of the data timing control signal (DTCS) supplied from the timing controller 200, whereby the reference voltage (Vref) is output during the partial period for each horizontal period (or the first half period), and the data voltage (Vdata) is output during the remaining period for each horizontal period (or the last half period).

The power supplier 500 generates the first and second driving voltages (V1, V2) for driving the pixel circuit by the use of externally-provided input power (Vin), and then supplies the generated first and second driving voltages (V1, V2) to the switching unit of the pixel circuit. In this case, the power supplier 500 may supply the first driving voltage (V1) to the first driving power source line (PL1) of the switching unit for the respective pixel circuits in common or individually. Also, the power supplier 500 may supply the second driving voltage (V2) to the second driving power source line (PL2) of the switching unit for the respective pixel circuits in common or individually.

As shown above, the light emitting display device according to the embodiment of the present invention includes the aforementioned pixel circuit according to the first embodiment of the present invention, and the image is displayed on the display panel 100 by the aforementioned driving method of the pixel circuit, to thereby achieve the efficiency of the pixel circuit.

Meanwhile, the light emitting display device according to the embodiment of the present invention may further include a detector (not shown) connected with at least one of the first and second driving power source lines (PL1, PL2), wherein the detector detects information about a threshold voltage of a driving transistor in each pixel circuit and/or deformation information of a light emitting device.

According to another aspect of the present invention, in the aforementioned light emitting display device according to the embodiment of the present invention, each pixel (P) of the display panel 100 includes the pixel circuit 110 according to the second embodiment of the present invention, which is described with reference to FIG. 6; and each pixel (P) for each horizontal line connected with each of the scanning line groups (SL1 to SLn) is driven by the driving method of the pixel circuit according to the second embodiment of the present invention, which is described with reference to FIGS. 7 and 8A to 8E, to thereby display the image. Thus, a detailed explanation for each pixel (P) and its driving method will be substituted by the above description of FIGS. 6, 7 and 8A to 8E. In this case, each pixel (P) of the display panel 100 may be formed every pixel region defined by a plurality of data lines (DL1 to DLm); a plurality of scanning line groups (SL1 to SLn), wherein each scanning line group is provided with a plurality of first to fourth switching control lines (SLi_1, SLi_2, SLi_3, SLi_4); and a plurality of first to third driving power source lines (PL1, PL2, PL3). The power supplier 500 may generate the third driving voltage (V3), and supply the generated third driving voltage (V3) to the third driving power source line (PL3) in common or individually.

As mentioned above, the pixel circuit and its driving method according to the present invention facilitates to realize the compensation by removing the threshold voltage (Vth) according to the operating state of the driving transistor (DT), and the voltage drop of the first driving voltage (V1) according to resistance of the first driving power source line (PL1), so that it is possible to prevent the picture quality from being lowered by the deviation of the threshold voltage (Vth) of the driving transistor (DT) and the voltage drop of the first driving voltage (V1).

Also, in case of the pixel circuit and its driving method according to the present invention, the compensation for the threshold voltage (Vth) of the driving transistor (DT) and the periodic light-emitting operation of the light emitting device (OLED) are performed by each horizontal line so that it is possible to prevent the flicker phenomenon. Thus, it is appropriate for realization of large size and high resolution.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A pixel circuit comprising:

a light emitting device including an organic light emitting cell formed between an anode electrode and a cathode electrode, wherein the light emitting device emits light by an electric current applied thereto;

a driving transistor which controls an operation of the light emitting device according to a voltage applied between gate and source terminals;

a capacitor including first and second terminals, wherein the first terminal is selectively supplied with a reference voltage and a data voltage of a data line, and the second terminal is connected with a first node corresponding to the gate terminal of the driving transistor; and a switching unit which initializes the capacitor during a current horizontal period, stores a sampling voltage including the data voltage and a threshold voltage of the driving transistor in the capacitor, and makes the light emitting device emit light on the basis of the sampling voltage stored in the capacitor whenever the data voltage and reference voltage are supplied to the data line after the current horizontal period, wherein the reference voltage and the data voltage are alternately supplied to the data line.

2. The pixel circuit according to claim 1, wherein the switching unit includes:

a first switching transistor which is switched according to a first switching control signal, thereby supplying the reference voltage to the first terminal of the capacitor during an initializing period for initializing the capacitor, and a light-emitting period for making the light emitting device emit light, and also supplying the data voltage to the first terminal of the capacitor during a sampling period for storing the sampling voltage in the capacitor;

a second switching transistor which is turned-on according to a second switching control signal during the initializing period and the sampling period, thereby connecting the first node with a second node corresponding to a drain terminal of the driving transistor;

a third switching transistor which is turned-on according to a third switching control signal during the initializing period and the light-emitting period, thereby connecting the second node with the anode electrode of the light emitting device; and an auxiliary capacitor which is connected with the first node, wherein the auxiliary capacitor prevents a change of current flowing in the light emitting device when the first terminal of the capacitor is floating by the turned-off first switching transistor.

3. The pixel circuit according to claim 1, wherein the switching unit supplies the reference voltage to the first terminal of the capacitor during a partial period of the current horizontal period, and simultaneously supplies an anode voltage to the first node of the light emitting device, thereby initializing the capacitor.

4. The pixel circuit according to claim 3, wherein the switching unit supplies the data voltage to the first terminal of the capacitor during the remaining period of the current horizontal period, and then stores the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

5. The pixel circuit according to claim 1, wherein the switching unit includes:

a first switching transistor which is switched according to a first switching control signal, thereby supplying the reference voltage to the first terminal of the capacitor during an initializing period for initializing the capacitor, and a light-emitting period for making the light emitting device emit light, and also supplying the data voltage to the first terminal of the capacitor during a sampling period for storing the sampling voltage in the capacitor;

a second switching transistor which is turned-on according to a second switching control signal during the initializing period and the sampling period, thereby connecting the first node with a second node corresponding to a drain terminal of the driving transistor;

a third switching transistor which is turned-on according to a third switching control signal during the initializing period and the light-emitting period, thereby connecting the second node with the anode electrode of the light emitting device;

a fourth switching transistor which is turned-on according to a fourth switching control signal during the initializing period and a partial period of the sampling period, thereby supplying an initializing voltage to the first node; and an auxiliary capacitor which is connected with the first node, wherein the auxiliary capacitor prevents a change of current flowing in the light emitting device when the first terminal of the capacitor is floating by the turned-off first switching transistor.

6. The pixel circuit according to claim 1, wherein the switching unit supplies the reference voltage to the first terminal of the capacitor during the partial period of the current horizontal period, and simultaneously supplies the initializing voltage to the first node, thereby initializing the capacitor.

7. The pixel circuit according to claim 6, wherein the switching unit supplies the data voltage to the first terminal of the capacitor during the remaining period of the current horizontal period, and then stores the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

8. The pixel circuit according to claim 1, wherein the switching unit makes the light emitting device emit light by supplying the reference voltage to the first terminal of the capacitor stored with the sampling voltage every partial period for each horizontal period after the current horizontal period, wherein the partial period indicates the period when the reference voltage is supplied to the data line; and makes the light emitting device emit light by floating the first terminal of the capacitor stored with the sampling voltage every remaining period for each horizontal period, wherein the remaining period indicates the period when the data voltage of the following horizontal period is supplied to the data line.

9. An organic light emitting display device comprising:

a display panel including a plurality of pixels with the pixel circuit;

a data driver for alternately supplying a reference voltage and a data voltage to a switching unit of the pixel circuit; and a scanning driver for switching the switching unit of the pixel circuit, wherein the pixel circuit includes:

a light emitting device including an organic light emitting cell formed between an anode electrode and a cathode electrode, wherein the light emitting device emits light by an electric current applied thereto;

a driving transistor which controls an operation of the light emitting device according to a voltage applied between gate and source terminals;

a capacitor including first and second terminals, wherein the first terminal is selectively supplied with a reference voltage and a data voltage of a data line, and the second terminal is connected with a first node corresponding to the gate terminal of the driving transistor; and a switching unit which initializes the capacitor during a current horizontal period, stores a sampling voltage including the data voltage and a threshold voltage of the driving transistor in the capacitor, and makes the light emitting device emit light on the basis of the sampling voltage stored in the capacitor whenever the data voltage and reference voltage are supplied to the data line after the current horizontal period, wherein the reference voltage and the data voltage are alternately supplied to the data line.

10. The organic light emitting display device according to claim 9, wherein the switching unit includes:

a first switching transistor which is switched according to a first switching control signal, thereby supplying the reference voltage to the first terminal of the capacitor during an initializing period for initializing the capacitor, and a light-emitting period for making the light emitting device emit light, and also supplying the data voltage to the first terminal of the capacitor during a sampling period for storing the sampling voltage in the capacitor;

a second switching transistor which is turned-on according to a second switching control signal during the initializing period and the sampling period, thereby connecting the first node with a second node corresponding to a drain terminal of the driving transistor;

a third switching transistor which is turned-on according to a third switching control signal during the initializing period and the light-emitting period, thereby connecting the second node with the anode electrode of the light emitting device; and an auxiliary capacitor which is connected with the first node, wherein the auxiliary capacitor prevents a change of current flowing in the light emitting device when the first terminal of the capacitor is floating by the turned-off first switching transistor.

11. The organic light emitting display device according to claim 9, wherein the switching unit supplies the reference voltage to the first terminal of the capacitor during a partial period of the current horizontal period, and simultaneously supplies an anode voltage to the first node of the light emitting device, thereby initializing the capacitor; and supplies the data voltage to the first terminal of the capacitor during the remaining period of the current horizontal period, and then stores the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

12. The organic light emitting display device according to claim 9, wherein the switching unit includes:

a first switching transistor which is switched according to a first switching control signal, thereby supplying the reference voltage to the first terminal of the capacitor during an initializing period for initializing the capacitor, and a light-emitting period for making the light emitting device emit light, and also supplying the data voltage to the first terminal of the capacitor during a sampling period for storing the sampling voltage in the capacitor;

a second switching transistor which is turned-on according to a second switching control signal during the initializing period and the sampling period, thereby connecting the first node with a second node corresponding to a drain terminal of the driving transistor;

a third switching transistor which is turned-on according to a third switching control signal during the initializing period and the light-emitting period, thereby connecting the second node with the anode electrode of the light emitting device;

a fourth switching transistor which is turned-on according to a fourth switching control signal during the initializing period and a partial period of the sampling period, thereby supplying an initializing voltage to the first node; and an auxiliary capacitor which is connected with the first node, wherein the auxiliary capacitor prevents a change of current flowing in the light emitting device when the first terminal of the capacitor is floating by the turned-off first switching transistor.

13. The organic light emitting display device according to claim 9, wherein the switching unit supplies the reference voltage to the first terminal of the capacitor during the partial period of the current horizontal period, and simultaneously supplies the initializing voltage to the first node, thereby initializing the capacitor; and supplies the data voltage to the first terminal of the capacitor during the remaining period of the current horizontal period, and then stores the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

14. The organic light emitting display device according to claim 9, wherein the switching unit makes the light emitting device emit light by supplying the reference voltage to the first terminal of the capacitor stored with the sampling voltage every partial period for each horizontal period after the current horizontal period, wherein the partial period indicates the period when the reference voltage is supplied to the data line; and makes the light emitting device emit light by floating the first terminal of the capacitor stored with the sampling voltage every remaining period for each horizontal period, wherein the remaining period indicates the period when the data voltage of the following horizontal period is supplied to the data line.

15. A driving method of a pixel circuit comprising a light emitting device including an organic light emitting cell formed between an anode electrode and a cathode electrode, a driving transistor which controls an operation of the light emitting device according to a voltage applied between gate and source terminals, and a capacitor including a first terminal and a second terminal connected with a first node corresponding to the gate terminal of the driving transistor, comprising:

alternately supplying a reference voltage and a data voltage to a data line;

initializing the capacitor during a current horizontal period, and then storing a sampling voltage including the data voltage and a threshold voltage of the driving transistor in the capacitor; and making the light emitting device emit light on the basis of the sampling voltage stored in the capacitor whenever the data voltage and reference voltage are supplied to the data line after the current horizontal period.

16. The driving method according to claim 15, wherein the step of initializing the capacitor includes supplying the reference voltage supplied to the data line to the first terminal of the capacitor during a partial period of the current horizontal period, and simultaneously supplying an anode voltage of the light emitting device to the first node so as to initialize the capacitor.

17. The driving method according to claim 16, wherein the step of storing the sampling voltage in the capacitor includes supplying the data voltage to the first terminal of the capacitor during the remaining period of the current horizontal period; and storing the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

18. The driving method according to claim 15, wherein the step of initializing the capacitor includes supplying the reference voltage supplied to the data line to the first terminal of the capacitor during a partial period of the current horizontal period, and simultaneously supplying an initializing voltage to the first node so as to initialize the capacitor.

19. The driving method according to claim 18, wherein the step of storing the sampling voltage in the capacitor includes supplying the data voltage to the first terminal of the capacitor during the remaining period of the current horizontal period; and storing the sampling voltage in the capacitor by connecting the gate and drain terminals of the driving transistor with each other, wherein the sampling voltage is obtained by adding the threshold voltage of the driving transistor, the data voltage and a first driving voltage supplied to the source terminal of the driving transistor.

20. The driving method according to claim 15, wherein the step of making the light emitting device emit light includes making the light emitting device emit light by supplying the reference voltage to the first terminal of the capacitor stored with the sampling voltage every partial period for each horizontal period after the current horizontal period, wherein the partial period indicates the period when the reference voltage is supplied to the data line; and making the light emitting device emit light by floating the first terminal of the capacitor stored with the sampling voltage every remaining period for each horizontal period, wherein the remaining period indicates the period when the data voltage of the following horizontal period is supplied to the data line.

* * * * *